US009063441B2

(12) United States Patent
Yamanami et al.

(10) Patent No.: US 9,063,441 B2
(45) Date of Patent: Jun. 23, 2015

(54) ELECTROPHOTOGRAPHIC PHOTOCONDUCTOR, IMAGE FORMING APPARATUS, AND PROCESS CARTRIDGE

(71) Applicants: Hirofumi Yamanami, Shizuoka (JP); Koji Enomoto, Kanagawa (JP); Naoyuki Esaki, Shizuoka (JP)

(72) Inventors: Hirofumi Yamanami, Shizuoka (JP); Koji Enomoto, Kanagawa (JP); Naoyuki Esaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 14/059,731

(22) Filed: Oct. 22, 2013

(65) Prior Publication Data

US 2014/0120463 A1 May 1, 2014

(30) Foreign Application Priority Data

Oct. 25, 2012 (JP) ..... 2012-235292

(51) Int. Cl.

| | |
|---|---|
| ***G03G 5/00*** | (2006.01) |
| ***G03G 5/05*** | (2006.01) |
| ***G03G 5/147*** | (2006.01) |
| *G03G 21/18* | (2006.01) |

(52) U.S. Cl.

CPC ..... *G03G 5/0578* (2013.01); *G03G 21/1814* (2013.01); *G03G 2215/00957* (2013.01); *G03G 5/0507* (2013.01); *G03G 5/0546* (2013.01); *G03G 5/14704* (2013.01); *G03G 5/14734* (2013.01); *G03G 5/14773* (2013.01)

(58) Field of Classification Search

CPC ..... G03G 5/14704
USPC ..... 430/66; 399/159
See application file for complete search history.

(56) References Cited

U.S. PATENT DOCUMENTS

| | | | | |
|---|---|---|---|---|
| 2003/0104295 | A1* | 6/2003 | Niimi | 430/59.4 |
| 2003/0232265 | A1 | 12/2003 | Yamanami et al. | |
| 2005/0170271 | A1 | 8/2005 | Yamanami et al. | |

FOREIGN PATENT DOCUMENTS

| | | |
|---|---|---|
| JP | 08-234471 | 9/1996 |
| JP | 08-314174 | 11/1996 |
| JP | 3753988 | 12/2005 |
| JP | 2010-014946 | 1/2010 |

OTHER PUBLICATIONS

Keiichi Inagaki et al., "Environmental Contribution by High Durable Organic Photoconductor/Developer Technology," Konica Minolta Technology Report, vol. 6, (2009), pp. 17-22.

* cited by examiner

*Primary Examiner* — Mark A Chapman
(74) *Attorney, Agent, or Firm* — Oblon, McClelland, Maier & Neustadt, L.L.P.

(57) ABSTRACT

Provided is an electrophotographic photoconductor including an electroconductive substrate, a photoconductive layer on the electroconductive substrate, and a protection layer on the photoconductive layer, wherein the protection layer contains two or more metal oxides having different average primary particle diameters, a binder resin, and a charge transporting material, the content of the metal oxides in the protection layer is 50% by mass or higher, and the average primary particle diameters of the metal oxides satisfy all of formula (I) to (III) below:

$d(1)<d(2)$ formula (I);

$d(1)/d(2)\leq 0.25$ formula (II); and $0.1\ \mu m\leq d(2)$ formula (III)

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

14 Claims, 4 Drawing Sheets

ELECTROPHOTOGRAPHIC PHOTOCONDUCTOR, IMAGE FORMING APPARATUS, AND PROCESS CARTRIDGE

BACKGROUND OF THE INVENTION

1. Field of the Invention

The present invention relates to an electrophotographic photoconductor (hereinafter may be referred to as "photoconductor"), an image forming apparatus, and a process cartridge.

2. Description of the Related Art

Image forming apparatuses such as copiers, printers, and facsimile machines employing an electrophotographic system form an electrostatic latent image on a photoconductor by irradiating the photoconductor, which is uniformly charged, with writing light modulated with image data. Then, the image forming apparatuses form a toner image on the photoconductor on which the electrostatic latent image is formed, by supplying a toner to the photoconductor from a developing unit.

Photoconductors that are most often used in such image forming apparatuses employing the electrophotographic system are organic photoconductors containing an organic photoconductive material. Organic photoconductors are advantageous over other types of photoconductors in that materials suitable for various exposure light sources from visible light to infrared light can be easily developed, in that materials with no environmental contamination can be selected, and in that they can be manufactured at low costs.

In each process of the toner image formation described above, it is known that friction occurs where the photoconductor contacts other image forming units than the photoconductor, such as a developing unit and a transfer unit.

However, conventional organic photoconductors have a poor mechanical strength to have their photoconductive layer wear from a long time of use, and cannot perform proper image formation when the photoconductive layer has been worn out by a certain amount, because this entails changes in the electric characteristics of the photoconductor.

Hence, in order to improve wear resistance, it is proposed to provide a surface protection layer on the photoconductive layer.

For example, the techniques (1) to (4) below are proposed as the surface protection layer to be provided on the photoconductor:

(1) a surface protection layer made of a curable silicon resin containing colloidal silica;

(2) a surface protection layer made of a resin of a curable organosilicon polymer in which an organosilicon-modified hole transporting compound is bonded;

(3) a surface protection layer made of a curable siloxane resin which contains a charge transportability imparting group and is cured in the form of a three-dimensional network; and (4) a surface protection layer made of a urethane resin obtained by crosslinking-polymerizing plural kinds of polyols and polyisocyanates.

However, the current situations are, a highly-durable electrostatic latent image bearing member, which has a high wear resistance and excellent electrophotographic properties and can perform stable image formation for a long time, and its associated techniques have not been obtained yet, and their urgent supply is requested.

For example, a photoconductor is proposed, which contains two or more fillers having different volume-average particle diameters in the protection layer, and has a particle size distribution gradient in which the filler particle diameters continuously increase from the photoconductive layer side to the surface side in the protection layer (see Japanese Patent (JP-B) No. 3,753,988). The photoconductor according to this proposal has a high durability and can obtain high-quality images stably against a long time of repetitive use.

However, even this proposed technique cannot be said to fully meet the recent years' rising requests to the photoconductors, and it is requested to realize wear resistance, electrophotographic properties, and durability that allows stable image formation for a long time, all at higher levels.

SUMMARY OF THE INVENTION

An object of the present invention is to provide a highly-durable electrophotographic photoconductor that has a high wear resistance and excellent electrophotographic properties, and can perform stable image formation for a long time.

An electrophotographic photoconductor of the present invention as a means for solving the problem is an electrophotographic photoconductor, including:

an electroconductive substrate;

a photoconductive layer on the electroconductive substrate; and a protection layer on the photoconductive layer, wherein the protection layer contains two or more metal oxides having different average primary particle diameters, a binder resin, and a charge transporting material, and wherein the content of the metal oxides in the protection layer is 50% by mass or higher, and the average primary particle diameters of the metal oxides satisfy all of formulae (I) to (III) below:

$$d(1)<d(2) \quad \text{formula (I);}$$

$$d(1)/d(2)\leq 0.25 \quad \text{formula (II); and}$$

$$0.1\ \mu m\leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

According to the present invention, it is possible to provide an electrophotographic photoconductor with a high durability that can overcome the conventional problems, has a high wear resistance and excellent electrophotographic properties, and can perform stable image formation for a long time.

Figure 1:
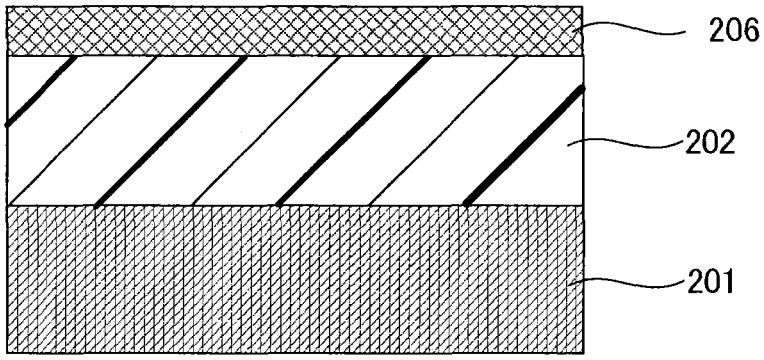
FIG. 1 is an exemplary cross-sectional diagram showing an example layer structure of an electrophotographic photoconductor of the present invention.

DETAILED DESCRIPTION OF THE INVENTION (Electrophotographic Photoconductor)

An electrophotographic photoconductor of the present invention is an electrophotographic photoconductor, including:

an electroconductive substrate;

a photoconductive layer on the electroconductive substrate; and a protection layer on the photoconductive layer, wherein the protection layer contains two or more metal oxides having different average primary particle diameters, a binder resin, and a charge transporting material, and wherein the content of the metal oxides in the protection layer is 50% by mass or higher, and the average primary particle diameters of the metal oxides satisfy all of formulae (I) to (III) below:

$$d(1)<d(2) \quad \text{formula (I);}$$

$$d(1)/d(2)\leq 0.25 \quad \text{formula (II); and}$$

$$0.1\ \mu m\leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

First, technical reasons for why the effects of the present invention are available will be explained.

In order to improve wear resistance, it is known to be good to increase the average primary particle diameter of the metal oxides to be contained in the outermost protection layer. It is also known that wear resistance is improved when the content of metal oxides in the protection layer is increased. However, when both of the average primary particle diameter and the content of the metal oxides to be contained in the protection layer are increased, the protection layer becomes hard but brittle, and consequently loses wear resistance, contrary to the intention.

This brittleness is due to the contraction of the protection layer when it is coated and dried, because the contraction only occurs in the binder resin portion, and when the content of the metal oxides is large, the metal oxides pulled by the contracting binder resin cannot move, hindered by neighboring metal oxides, producing voids where the contracted resin has been, to make the protection layer brittle.

Therefore, an approach of increasing the content while saving the average primary particle diameter, or saving the content while increasing the average primary particle diameter has been conventionally employed. However, although this approach is effective to some degree for improving the wear resistance, it has turned out that the approach has limitations to improving the wear resistance.

According to the configuration of the present invention, small metal oxide particles are provided between large metal oxide particles, which increases the area occupied by the metal oxides in the surface of the protection layer to consequently increase the occupation ratio of the metal oxides in the portion where the photoconductor contacts surrounding members to come into contact, which turns out to greatly improve the wear resistance.

Because the protection layer of the present invention has a very high content of metal oxides and contains two or more metal oxides, it agglomerates very easily. As a result, it may not fully exhibit an effect of improving the durability.

Therefore, according to the present invention, it is preferable to add an acid group-containing compound to the protection layer. The acid group-containing compound is preferable, because it adsorbs to the metal oxides to consequently improve the dispersion of the metal oxides in the protection layer to contribute to further improvement of the wear resistance.

According to the present invention, it is also preferable to add to the binder resin, a product obtained by curing an acrylic resin and a silane coupling agent. The silane coupling agent serves not only as a curing agent for the acrylic resin but also as a mediator for the cured product and the metal oxides to increase the binding force between the cured product and the metal oxides to contribute to further improvement of the wear resistance.

According to the present invention, it is also preferable to add to the binder resin, a product obtained by curing an acrylic resin and an alkoxy oligomer. An alkoxy oligomer serves not only as a curing agent for the acrylic resin but also as a mediator for the cured product and the metal oxides to increase the binding force between the cured product and the metal oxides to contribute to further improvement of the wear resistance.

Next, an electrophotographic photoconductor, an image forming apparatus, and a process cartridge of the present invention will be explained in greater detail.

An embodiment to be described below is a preferred embodiment of the present invention and hence has various limitations that are technically preferable. However, the scope of the present invention is not limited to these aspects, unless otherwise expressly stated in the following explanation.

<Electrophotographic Photoconductor>

The electrophotographic photoconductor of the present invention includes an electroconductive substrate, a photoconductive layer provided on the electroconductive substrate, and a protection layer provided on the photoconductive layer, and if necessary, intermediate layer and other layers.

[Layer Structure of Electrophotographic Photoconductor]

In the first embodiment, the electrophotographic photoconductor includes a single-layer photoconductive layer and a protection layer on an electroconductive substrate (hereinafter may be referred to simply as a substrate), and further includes intermediate layers and other layers, if necessary.

In the second embodiment, the electrophotographic photoconductor includes an electroconductive substrate and a multilayer photoconductive layer including a charge generating layer, a charge transporting layer, and a protection layer on the electroconductive substrate in this order, and further includes intermediate layers and other layers, if necessary.

In the second embodiment, the stacking order of the charge generating layer and the charge transporting layer may be reversed.

FIG. 1 is an exemplary cross-sectional diagram of an electrophotographic photoconductor according to the present invention, showing a configuration in which a single-layer photoconductive layer 202 and a protection layer 206 are formed on an electroconductive substrate 201.

FIG. 2, FIG. 3, FIG. 4, and FIG. 5 are exemplary cross-sectional diagrams showing other layer structure examples of the electrophotographic photoconductor according to the present invention.

Figure 2:
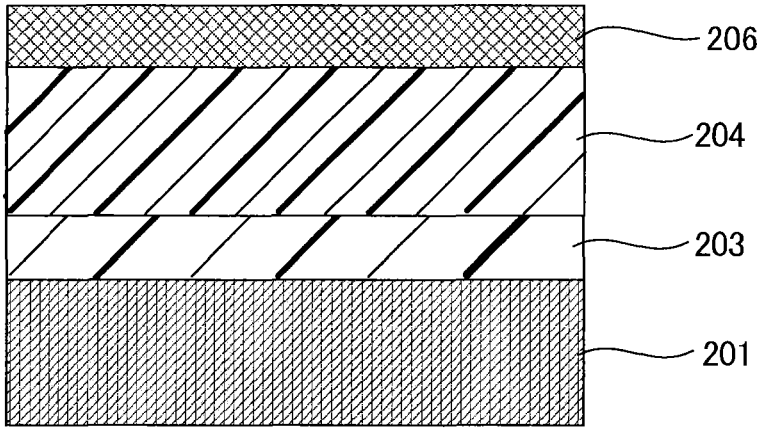
FIG. 2 is an exemplary cross-sectional diagram showing another example layer structure of the electrophotographic photoconductor of the present invention.

FIG. 2 shows an example in which the photoconductive layer is a functionally-divided type constituted by a charge generating layer (CGL) 203 and a charge transporting layer (CTL) 204, and a protection layer 206 is provided on this photoconductive layer.

Figure 3:
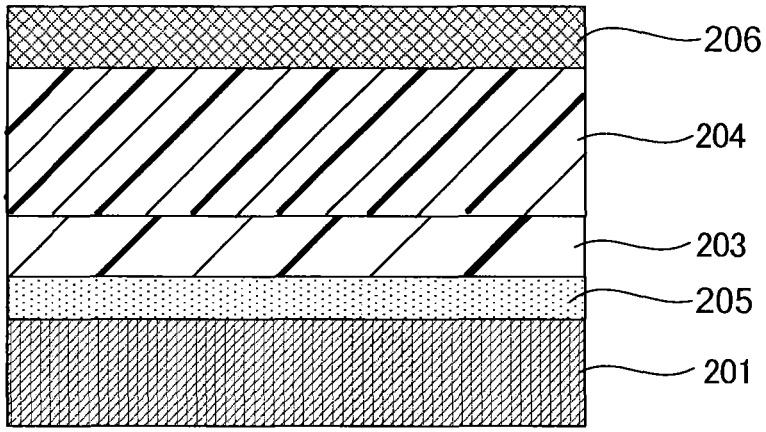
FIG. 3 is an exemplary cross-sectional diagram showing another example layer structure of the electrophotographic photoconductor of the present invention.

FIG. 3 shows an example that includes an undercoat layer 205 between an electroconductive substrate 201 and a charge generating layer (CGL) 203 of a functionally-divided type photoconductive layer.

Figure 4:
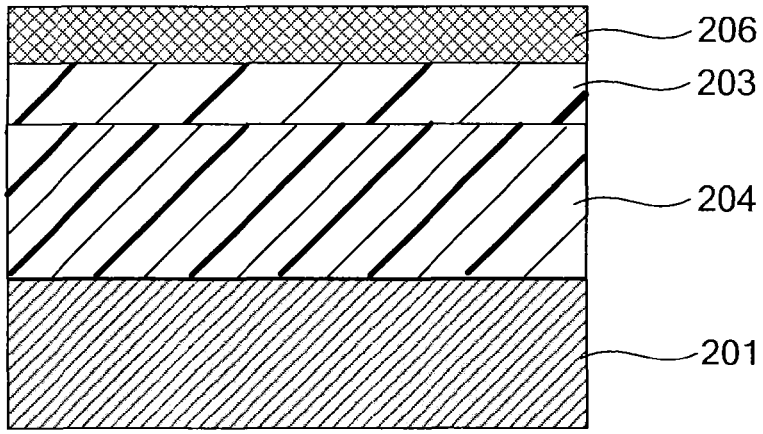
FIG. 4 is an exemplary cross-sectional diagram showing another example layer structure of the electrophotographic photoconductor of the present invention.

FIG. 4 shows an example in which a charge transporting layer 204 and a charge generating layer 203 are provided on the electroconductive substrate 201, and a protection layer 206 is stacked thereon.

Figure 5:
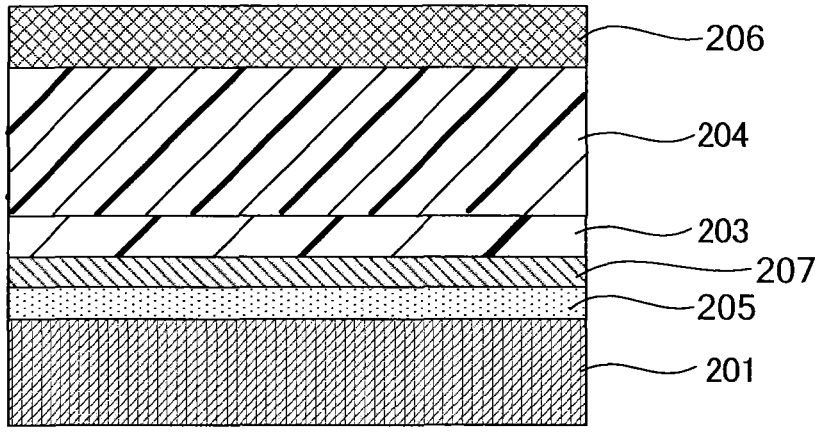
FIG. 5 is an exemplary cross-sectional diagram showing another example layer structure of the electrophotographic photoconductor of the present invention.

FIG. 5 shows an example that includes an intermediate layer 207 between an undercoat layer 205 and a charge generating layer 203.

In the electrophotographic photoconductor of the present invention, the types of the other layers mentioned above and the types of the photoconductive layer may be combined in an arbitrary manner.

[Protection Layer]

The protection layer is characterized in that it contains two or more metal oxides having different average primary particle diameters, a binder resin, and a charge transporting material, in that the content of the metal oxides in the protection layer is 50% by mass or higher, and in that the average primary particle diameters of the metal oxides satisfy all of the formulae (I) to (III) below.

$$d(1)<d(2) \quad \text{formula (I)}$$

$$d(1)/d(2)\leq 0.25 \quad \text{formula (II)}$$

$$0.1\ \mu m\leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

Metal Oxides

In order to improve wear resistance, it is known to be good to increase the average primary particle diameter of the metal oxides to be contained in the protection layer. It is also known that wear resistance is improved when the content of metal oxides in the protection layer is increased.

However, when both of the average primary particle diameter and the content of the metal oxides to be contained in the protection layer are increased, the protection layer becomes hard but brittle, and consequently loses wear resistance, contrary to the intention.

This brittleness is due to the contraction of the protection layer when it is coated and dried, because the contraction only occurs in the binder resin portion, and when the content of the metal oxides is large, the metal oxides pulled by the contracting binder resin cannot move, hindered by neighboring metal oxides, producing voids where the contracted resin has been, to make the protection layer brittle.

As a result, an approach of increasing the content while saving the average primary particle diameter, or saving the content while increasing the average primary particle diameter has been generally employed.

Although this approach is effective to some degree for improving the wear resistance, it has limitations to improving the wear resistance.

Hence, with two or more metal oxides having different average primary particle diameters added as described above, small metal oxide particles are provided between large metal oxide particles, which increases the area occupied by the metal oxides in the surface to consequently increase the occupation ratio of the metal oxides in the portion where the photoconductor contacts surrounding members to come into contact, which greatly increases the wear resistance.

The content of the metal oxides in the protection layer is 50% by mass or higher, preferably 60% by mass or higher. If the content is lower than 50% by mass, the hardness of the protection layer is not high enough, with no contribution to the wear resistance.

Examples of the metal oxides include zinc oxide, titanium oxide, tin oxide, antimony oxide, indium oxide, aluminum oxide, tin-doped indium oxide, tin-doped tin oxide, antimony-doped tin oxide, antimony-doped zirconium oxide, and antimony-doped zinc oxide.

The combination of the metal oxides having different average primary particle diameters may be combination of the same metal oxide or may be combination of different kinds of metal oxides.

Assuming that A is the content of the metal oxide with an average primary particle diameter d(1), and B is the content of the metal oxide particles with an average primary particle diameter d(2), it is preferable that the formula (IV) below be satisfied.

$$1/5\leq A/B\leq 5/1 \quad \text{formula (IV)}$$

When A/B is larger than 5/1, adding a metal oxide having a large particle diameter is poorly effective for improving the wear resistance. Conversely, when A/B is smaller than 1/5, the layer is brittle and has a poor wear resistance. A more preferable relationship between A and B is $1/4\leq A/B\leq 4/1$.

Furthermore, it is preferable that, of the metal oxides to be added, the metal oxide having the average primary particle diameter d(1) (smaller primary average particle diameter) be a conductive metal oxide, because this not only improves the wear resistance but also reduces the environmental dependency of the electrophotographic photoconductor characteristics.

It is possible to obtain the average primary particle diameter by directly measuring the particle diameter of particles with, for example, transmission electron microcope (TEM), a scanning electron microscope (SEM), etc.

Binder Resin

Next, the resin to be used as the binder will be explained.

Examples of the binder resin include a polycarbonate resin, a polyester resin, a methacrylic resin, an acrylic resin, a polyethylene resin, a polyvinyl chloride resin, a polyvinyl acetate resin, a polystyrene resin, a phenol resin, an epoxy resin, a polyurethane resin, a polyvinylidene chloride resin, an alkyd resin, a silicone resin, a polyvinyl carbazole resin, a polyvinyl butyral resin, a polyvinyl formal resin, a polyacrylate resin, a polyacrylamide resin, and a phenoxy resin.

These may be used alone, or two or more of these may be used in combination to form a crosslinked structure.

Further, as described above, it is preferable that the binder resin contain a product obtained by curing an acrylic resin and a silane coupling agent.

The acrylic resin is not particularly limited as long as it is generally used as a thermosetting resin. Specific examples thereof include ACRYDIC BZ-1161, ACRYDIC A-9540, ACRYDIC A9510, and ACRYDIC A9521 (manufactured by DIC Corporation); and KAYARAD R-526, NPGDA, PEG400DA, FM-400, R-167, HX-220, HX-620, R-551, R-712, R-604, R-684, GPO-303, TMPTA, THE-330, TPA-320, TPA-330, PET-30, T-1420(T), RP-1040, DPHA, DPEA-12, DPHA-2C, D-310, D-330, DPCA-20, DPCA-30, DPACA-60, DPCA-120, DN-0075, PM-2, and PM-21 (manufactured by Nippon Kayaku Co., Ltd.).

The silane coupling agent used in the present invention serves as a curing agent for the acrylic resin. The silane coupling agent contains two functional groups in one molecule, namely an organic functional group such as a vinyl group, an epoxy group, an amino group, and a methacrylic group, and an alkoxy group such as a methoxy group and an ethoxy group.

An alkoxy group reacts with an inorganic material, whereas an organic functional group reacts with an organic material such as a resin.

Specific examples of the silane coupling agent include: KBM-1003, KBE-1003, KBM303, KBM-402, KBM-403, KBE-402, KBE403, KBM-1403, KBM-502, KBM-503, KBE-502, KBE-503, KBM-5103, KBM-602, KBM-603, KBM-903, KBE-903, KBE-9103, KBM573, and KBM-575 (manufactured by Shin-Etsu Chemical Co., Ltd.); and Z6043, Z6040, Z6020, Z6094, Z6011, Z6883, Z6030, Z6300, Z6519, and Z6062 (manufactured by Dow Corning Toray Co., Ltd.).

The compounding ratio between the acrylic resin and the silane coupling agent is preferably 1/1 to 10/1. An excessively large amount of acrylic resin is poorly effective for the wear resistance, whereas an excessively large amount of the silane coupling agent largely increases the viscosity of the coating liquid.

It is also preferable that the binder resin contain a product obtained by curing an acrylic resin and an alkoxy oligomer, as described above.

An alkoxy oligomer used in the present invention serves as a curing agent for the acrylic resin.

The acrylic resin is not particularly limited as long as it is generally used as a thermosetting resin. Specific examples thereof include ACRYDIC BZ-1161, ACRYDIC A-9540, ACRYDIC A9510, and ACRYDIC A9521 (manufactured by DIC Corporation); and KAYARAD R-526, NPGDA, PEG400DA, FM-400, R-167, HX-220, HX-620, R-551, R-712, R-604, R-684, GPO-303, TMPTA, THE-330, TPA-320, TPA-330, PET-30, T-1420(T), RP-1040, DPHA, DPEA-12, DPHA-2C, D-310, D-330, DPCA-20, DPCA-30, DPACA-60, DPCA-120, DN-0075, PM-2, and PM-21 (manufactured by Nippon Kayaku Co., Ltd.).

An alkoxy oligomer is a low-molecular resin having an organic group together with an alkoxy silyl group (═Si—OR). In the present invention, an oligomer having an organic functional group such as a methyl group, a phenyl group, an epoxy group, and a mercapto group is particularly preferable.

Specific examples of alkoxy oligomers include X-41-1053, X-41-1059A, X-41-1056, X-41-1805, X-41-1818, X-41-1810, X-40-2651, X-40-2655A, KR-513, KC-89S, KR-500, X-40-9225, X-40-9246, X-40-9250, KR-401N, X-40-9227, X-40-9247, KR-510, KR-9218, KR-213, X-40-2308, and X-40-9238 (manufactured by Shin-Etsu Chemical Co., Ltd.).

Charge Transporting Material

Next, a charge transporting material will be explained.

Examples of the charge transporting material include but are not limited to materials having the structures described below.

(a) Polymers having a carbazole ring: examples thereof include poly-N-vinyl carbazole, and the compounds described in Japanese Patent Application Laid-Open (JP-A) Nos. 50-82056, 54-9632, 54-11737, 04-175337, 04-183719, and 06-234841.

(b) Polymers having a hydrazone structure: examples thereof include the compounds described in JP-A Nos. 57-78402, 61-20953, 61-296358, 01-134456, 01-179164, 03-180851, 03-180852, 03-50555, 05-310904, and 06-234840.

(c) Polysilylene polymers: examples thereof include the compounds described in JP-A Nos. 63-285552, 01-88461, 04-264130, 04-264131, 04-264132, 04-264133, and 04-289867.

(d) Polymers having a triaryl amine structure: examples thereof include N,N-bis(4-methylphenyl)-4-amino polystyrene, and the compounds described in JP-A Nos. 01-134457, 02-282264, 02-304456, 04-133065, 04-133066, 05-40350, and 05-202135.

(e) Other polymers: examples thereof include a formaldehyde condensation polymerization product of nitropyrene, and the compounds described in JP-A Nos. 51-73888, 56-150749, 06-234836, and 06-234837.

The charge transporting material may also be a high-molecular charge transporting material, and examples thereof include a polycarbonate resin having a triaryl amine structure, a polyurethane resin having a triaryl amine structure, a polyester resin having a triaryl amine structure, and a polyether resin having a triaryl amine structure.

Examples of the high-molecular charge transporting material include the compounds described in JP-A Nos. 64-1728, 64-13061, 64-19049, 04-11627, 04-225014, 04-230767, 04-320420, 05-232727, 07-56374, 09-127713, 09-222740, 09-265197, 09-211877, and 09-304956.

Examples of polymers having an electron-donating group include copolymers with conventional monomers, block polymers, graft polymers, and star polymers, and a crosslinked polymer having an electron-donating group as described in JP-A No. 03-109406.

Acid Group-Containing Compound

Next, an acid group-containing compound will be explained.

As described above, it is preferable that the protection layer 206 contain an acid group-containing compound.

Examples of the acid group-containing compound include a compound having a carboxyl group and a compound having a sulfone group.

Among them, a compound having a carboxyl group is particularly preferable.

As the compound having a carboxyl group, any compound that contains a carboxyl group in the molecular structure can be used, such as organic fatty acid, high acid value resin, and copolymer that are commonly known.

For example, saturated fatty acid and unsaturated fatty acid such as lauric acid, stearic acid, arachidic acid, behenic acid, adipic acid, oleic acid, maleic acid, maleic acid anhydride, salicylic acid, phthalic acid, isophthalic acid, terephthalic acid, and pyromellitic acid, and any kind of carboxylic acid such as aromatic carboxylic acid can be used.

Further, any polymers, oligomers, and copolymers, of which basic skeleton is saturated or unsaturated carbon hydride, and to which at least one or more carboxyl group is bonded, can be effectively used, such as saturated polyester, unsaturated polyester, unsaturated polyester having a carboxyl group at the terminal, styrene-maleic acid copolymer, and styrene-maleic acid anhydride.

Among these carboxylic acid compounds, a polycarboxylic acid compound that has a plurality of carboxylic groups and can compatibly dissolve with an organic solvent has a high acid value, tends to have increased adsorbability to the metal oxides, and is particularly effective and useful for improving the dispersibility of the metal oxides.

The surface of the metal oxides has a polar group, and a carboxyl group tends to adsorb to this polar group.

Further, these carboxylic acid compounds have an effect of improving the dispersibility of the metal oxides by imparting affinity to between the metal oxides and the binder resin to increase their wettability, and at the same time, giving steric hindrance or electric repulsion to between the metal oxides themselves to reduce interaction between themselves and increase their stability.

The content of the carboxylic acid compound is preferably from 0.1% by mass to 5% by mass relative to the metal oxides.

[Method for Manufacturing Protection Layer]

Next, a method for manufacturing a protection layer coating liquid will be explained.

First, a dispersion liquid of the metal oxides is prepared by dispersing the metal oxides in an organic solvent, by a dispersion method using dispersion media such as a ball mill, a beads mill, a sand mill, and a vibration mill, or a high-speed liquid collision dispersion method.

The protection layer coating liquid can be prepared by mixing this metal oxide dispersion liquid with a dissolution liquid obtained by dissolving the above-described charge transporting material and binder resin (the same applies when it contains an acrylic resin and a silane coupling agent or an acrylic resin and an alkoxy oligomer) in an appropriate solvent.

The acid group-containing compound may be dispersed together with the metal oxides in the organic solvent by various dispersion methods, or may be added lastly to the coating liquid and stirred and dissolved therein by a stirrer or the like.

Examples of the organic solvent that can be used include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolan, dioxane, methanol, ethanol, isopropyl alcohol, butanol, ethyl acetate, butyl acetate, dimethyl sulfoxide, methyl cellosolve, ethyl cellosolve, and propyl cellosolve. These may be used alone, or two or more of them may be used in combination.

The protection layer 206 can be formed by coating the layer on which the protection layer is needed with this protection layer coating liquid and drying the liquid.

The coating method may be any commonly used method, such as immersion coating and spray coating.

In addition to the charge transporting material and the binder resin, additives such as a plasticizer, an antioxidant, a leveling agent, and a dispersant may also be added to the protection layer 206 in an appropriate amount, if necessary.

The thickness of the protection layer 206 is preferably 1 μm to 10 μm.

In the present invention, the protection layer 206 needs not be thick because it is very highly wear-resistant.

[Electroconductive Substrate 201]

The electroconductive substrate 201 of the electrophotographic photoconductor of the present invention is not particularly limited as long as it has conductivity, and can be appropriately selected according to the purpose.

As the material of the electroconductive substrate 201, a conductor or an insulator subjected to conductive treatment is preferable. Examples of the material include: metals such as Al, Ni, Fe, Cu, and Au or alloys thereof; an insulating base made of polyester, polycarbonate, polyimide, or glass on which a metal such as Al, Ag, and Au or a conductive material such as $In_2O_3$ and $SnO_2$ is thinly deposited; a resin base obtained by uniformly dispersing carbon black, graphite, metal powder such as of Al, Cu, and Ni, or a conductive glass powder in a resin to impart conductivity to the resin; and paper subjected to conductive treatment.

The shape and size of the electroconductive substrate 201 are not particularly limited, and an electroconductive substrate of any of a plate shape, a drum shape, and a belt shape may be used.

When a substrate of a belt shape is used, the apparatus might be complicated or grow in size, whereas there are also advantages such as increased latitude of layout.

However, when the protection layer 206 is formed, the surface might be cleaved to have so-called cracks due to shortage of flexibility in the protection layer 206, which might cause dot-shaped background smear.

Hence, a highly stiff drum-shaped substrate is preferable as the electroconductive substrate 201.

[Photoconductive Layer 202, Charge Generating Layer (CGL) 203, Charge Transporting Layer (CTL) 204]

The photoconductive layer 202, the charge generating layer (CGL) 203, and the charge transporting layer (CTL) 204 of the present invention are not particularly limited, and conventionally well-known and commonly-used ones can be used as them. The method for manufacturing them is also not limited in particular.

[Undercoat Layer 205]

An undercoat layer 205 may be provided between the electroconductive substrate 201 and the photoconductive layer 202, if necessary.

The undercoat layer 205 is provided for the purposes of increasing adhesiveness, preventing moiré, improving coating easiness for upper layers, and reducing residual potential.

The main component of the undercoat layer 205 is typically a resin. It is preferable that such a resin be a resin that is highly insoluble to typical organic solvents, in view of the fact that the photoconductive layer 202 is to be deposited thereon by coating using a solvent.

Examples of such a resin include: water-soluble resins such as polyvinyl alcohol, casein, and sodium polyacrylate; alcohol-soluble resins such as copolymerized nylon and methoxymethylated nylon; and curable resins forming a three-dimensional network structure such as polyurethane, melamine resin, alkyd-melamine resin, and epoxy resin.

Further, fine powders of metal oxides such as titanium oxide, silica, alumina, zirconium oxide, tin oxide, and indium oxide, metal sulfide, or metal nitride may also be added.

Such an undercoat layer 205 can be formed by commonly-used coating methods using an appropriate solvent.

The undercoat layer may also be: a metal oxide layer formed by, for example, sol-gel method using a silane coupling agent, a titanium coupling agent, or a chromium coupling agent; $Al_2O_3$ deposited by anodization; and organic substances such as polyparaxylylene (parylene) or inorganic substances such as $SnO_2$, $TiO_2$, ITO, and $CeO_2$ deposited by vacuum thin-film deposition.

The thickness of the undercoat layer is not particularly limited and can be appropriately selected according to the purpose, but is preferably from 0.1 μm to 10 μm, and more preferably from 1 μm to 5 μm.

[Intermediate Layer 207]

In the electrophotographic photoconductor of the present invention, an intermediate layer 207 may be provided on the electroconductive substrate 201 if necessary, for improving adhesiveness and charge blocking property.

The main component of the intermediate layer 207 is typically a resin. It is preferable that such a resin be a resin that is highly insoluble to typical organic solvents, in view of the fact that the photoconductive layer 202 is to be deposited thereon by coating using a solution containing a solvent.

Examples of the resin for the intermediate layer 207 include: water-soluble resins such as polyvinyl alcohol, casein, and sodium polyacrylate; alcohol-soluble resins such as copolymerized nylon and methoxymethylated nylon; and curable resins forming a three-dimensional network structure such as polyurethane resin, melamine resin, phenol resin, alkyd-melamine resin, and epoxy resin.

(Image Forming Apparatus and Image Forming Method)

An image forming apparatus of the present invention includes at least an electrophotographic photoconductor, a charging unit, an exposure unit, a developing unit, a transfer unit, and a fixing unit, and further includes other units appropriately selected according to the necessity, such as a cleaning unit, a neutralizing unit, a recycling unit, and a control unit. The neutralizing unit and the exposure unit may be referred to as an electrostatic latent image forming unit in combination.

The image forming method used in the present invention includes at least a charging step, an exposure step, a developing step, a transfer step, and a fixing step, and further includes other steps appropriately selected according to the necessity, such as a cleaning step, a neutralizing step, a recycling step, and a control step. The neutralizing step and the exposure step may be referred to as an electrostatic latent image forming step in combination.

The image forming method used in the present invention can be preferably performed by the image forming apparatus of the present invention. The charging step can be performed by the charging unit. The exposure step can be performed by the exposure unit. The developing step can be performed by the developing unit. The transfer step can be performed by the transfer unit. The fixing step can be performed by the fixing unit. The other steps mentioned above can be performed by the other units mentioned above.

Next, the image forming method and image forming apparatus used in the present invention, and a process cartridge will be explained in detail with reference to the drawings.

Figure 6:
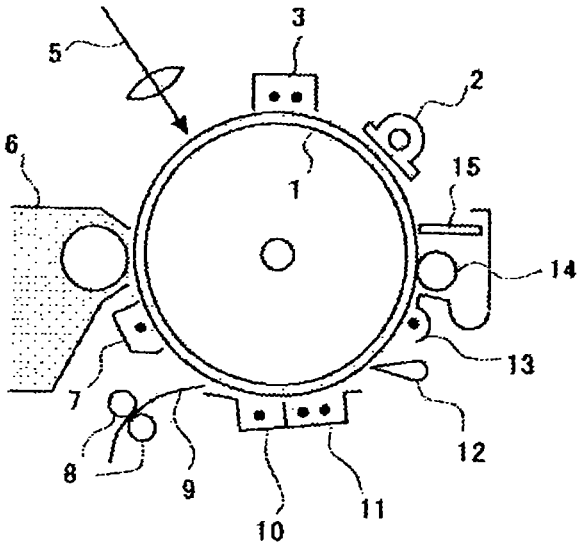
FIG. 6 is a schematic diagram showing an example electrophotographic image forming apparatus of the present invention.

FIG. 6 is a schematic diagram for explaining the image forming method and image forming apparatus used in the present invention. Examples to be described below are also included in the scope of the present invention.

In FIG. 6, a photoconductor 1 is shown having a drum shape. However, in the present invention, the photoconductor may be of a sheet shape or an endless belt shape, as described above.

A corotron, a scorotron, a solid-state charging device (solid-state charger), a charging roller, or any conventional means can be used as a charger 3, a pre-transfer charger 7, a transfer charger 10, and a pre-cleaning charger 13.

Generally, the chargers described above can be used as the transfer unit. However, such a device as shown in FIG. 6 obtained by combining the transfer charger 10 and a separating charger 11 is effective.

As the light sources of an image exposure unit 5 and a neutralizing lamp 2, light emitting products such as a fluorescent lamp, a tungsten lamp, a halogen lamp, a mercury lamp, a sodium-vapor lamp, a light emitting diode (LED), a laser diode (LD), and an electroluminescence (EL) lamp can be generally used.

In order to emit light of only a desired wavelength range, various filters can be used such as a sharp cut filter, a band pass filter, a near-infrared cut filter, a dichroic filter, an interference filter, and a color temperature conversion filter.

The light sources irradiate the photoconductor with light through the steps shown in FIG. 6, and in addition, through a transfer step, a neutralizing step, a cleaning step, or a pre-exposure step in which light irradiation is also performed.

A toner developed on the photoconductor 1 by the developing unit 6 is transferred to a transfer sheet 9 conveyed from a pair of registration rollers 8. The toner is not fully transferred, but remains on the photoconductor 1 in a certain amount.

The remaining toner is removed from the photoconductor by a fur brush 14 and a cleaning brush 15.

The transfer sheet 9 after transfer is separated by a separating claw 12 and conveyed to an unillustrated fixing unit.

In some cases, cleaning is performed only by a cleaning brush. A conventional brush such as a fur brush and a magfur brush is used as the cleaning brush.

When the electrophotographic photoconductor 1 is charged positively (negatively) and subjected to image exposure, a positive (negative) electrostatic latent image is formed on the surface of the photoconductor.

When the electrostatic latent image is developed with a toner (charge-detecting particles) having a negative (positive) polarity, a positive image is obtained. When the electrostatic latent image is developed with a toner having a positive (negative) polarity, a negative image is obtained.

A conventional means is used as the developing unit, and a conventional means is used as the neutralizing unit.

Figure 7:
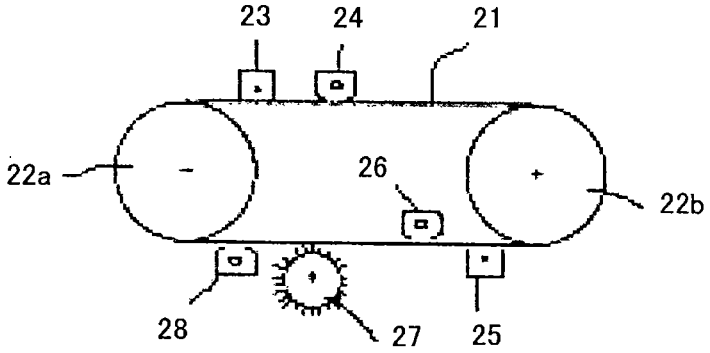
FIG. 7 is a schematic diagram showing another example electrophotographic image forming apparatus of the present invention.

FIG. 7 shows another example electrophotographic process according to the present invention.

A photoconductor 21 is driven by driving rollers 22*a* and 22*b* to be subjected to charging by a charging device (charger) 23, image exposure by a light source (image exposure light source) 24, development (not shown), and transfer using a charging device (charger) 25. Image formation is performed in this way. Then, the photoconductor is repeatedly subjected to pre-cleaning exposure by a light source (for pre-cleaning exposure) 26, cleaning by a brush (cleaning brush) 27, and neutralization by a light source (neutralizing light source) 28 to be served for the next image formation.

In FIG. 7, light irradiation to the photoconductor 21 for the pre-cleaning exposure is from the substrate side (in this case, the substrate is light-transmissive, needless to say).

The described electrophotographic process shown in the drawing is an example embodiment of the present invention, and other embodiments are also possible.

For example, in FIG. 7, pre-cleaning exposure is from the substrate side, but it may be from the photoconductive layer side. Furthermore, image exposure and irradiation of neutralizing light may be from the substrate side.

Image exposure, pre-cleaning exposure, and neutralizing exposure are shown in the drawing as light irradiation steps. In addition, pre-transfer exposure, pre-exposure of image exposure, and other conventional light irradiation steps may also be provided to subject the photoconductor to light irradiation.

Such an image forming unit as described above may be fixedly incorporated into a copier, a facsimile machine, or a printer, but may be incorporated into such a machine in the form of a process cartridge.

A process cartridge is a one-unit device (part) that houses a photoconductor therein, and in addition, includes a charging unit, an exposure unit, a developing unit, a transfer unit, a cleaning unit, and a neutralizing unit.

Figure 8:
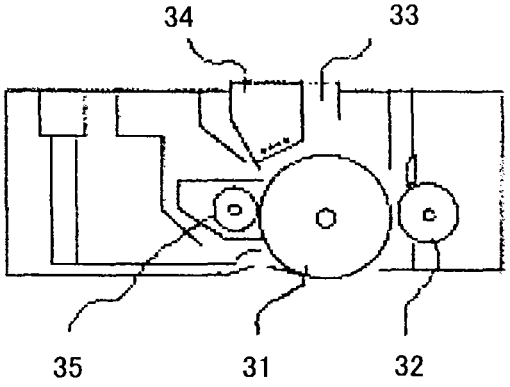
FIG. 8 is a schematic diagram showing an example process cartridge of the present invention.

Many examples can be raised as the structure of the process cartridge, but a typical example is one that is shown in FIG. 8.

In the process cartridge shown in FIG. 8, a photoconductor 31, a charger 34 for charging this photoconductor, a developing roller 32 for developing an electrostatic latent image, and a cleaning brush 35 for cleaning the surface of the photoconductor 31 after a toner image has been transferred are integrated. This process cartridge has a portion 33 to which light from an image exposure device is incident, such that an electrostatic latent image is formed on the charged surface of the photoconductor 31 by an image-like exposure.

EXAMPLES

Next, the present invention will be explained in greater detail based on Examples. However, the present invention is not limited to Examples to be described below.

Example 1

An alkyd resin (BECKOLITE M-6401-50, 50% by mass solid content, manufactured by DIC Corporation) (15 parts by mass), and a melamine resin (SUPERBECKAMINE G-821-60, 60% by mass solid content, manufactured by DIC Corporation) (10 parts by mass) were dissolved in methyl ethyl ketone (50 parts by mass).

Titanium oxide (CR-EL manufactured by Ishihara Sangyo Kaisha, Ltd.) (45 parts by mass) was added thereto, and the resultant was subjected to dispersion for 36 hours with a ball mill using alumina balls as media, to thereby obtain an intermediate layer coating liquid.

An aluminum drum having a diameter of 40 mm and a length of 346 mm was coated with the obtained liquid, dried for 20 minutes at 140° C., to thereby form an intermediate layer with a thickness of 3.0 μm.

Next, a butyral resin (S-LEC BMS manufactured by Sekisui Chemical Co., Ltd.) (5 parts by mass) was dissolved in cyclohexanone (20 parts by mass), an azo pigment having a structural formula (1) below (2 parts by mass) was added thereto, and the resultant was subjected for dispersion for 72 hours with a ball mill.

Structural formula (1)

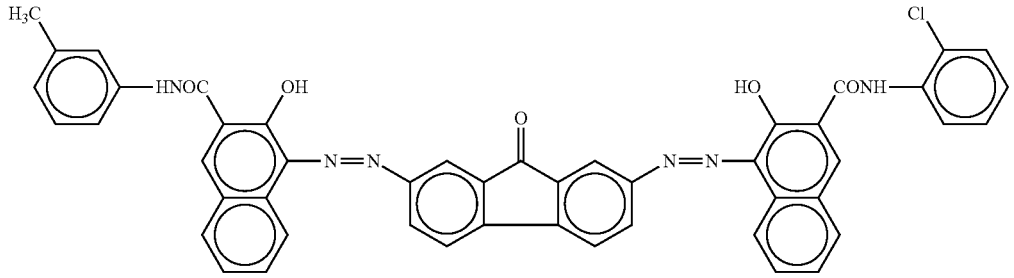

Cyclohexanone (21 parts by mass) was further added thereto, and the resultant was subjected for dispersion for 5 hours. The resultant was stirred and diluted with a mixed liquid of cyclohexanone/methyl ethyl ketone=2/1, such that the solid content would be 2.0% by mass.

A charge generating layer coating liquid was obtained in this way, and the intermediate layer was coated with this liquid by immersion and dried for 20 minutes at 130° C., to thereby form a charge generating layer having a thickness of 0.2 μm.

A charge transporting material having a structural formula (2) below (8 parts by mass), a polycarbonate resin with a bisphenol Z type structure (PANLITE TS2050 manufactured by Teijin Chemicals Ltd.) (10 parts by mass), and a silicone oil (KF-50 manufactured by Shin-Etsu Chemical Co., Ltd.) (0.02 parts by mass) were dissolved in tetrahydrofuran (77 parts by mass), to thereby obtain a charge transporting layer coating liquid.

Structural formula (2)

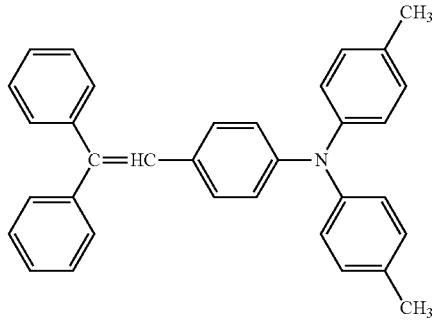

The charge generating layer was coated with the obtained charge transporting layer coating liquid by immersion immediately after the liquid was obtained. Then, the coated liquid was dried for 20 minutes at 135° C., to form a charge transporting layer having a thickness of 22 μm.

Next, conductive phosphorus-doped tin oxide (CELNAX CXS3031P, 30% by mass solid content, manufactured by Nissan Chemical Industries, Ltd., average primary particle diameter of 0.03 μm) (8.5 parts by mass) was diluted with cyclohexanone (15 parts by mass) and tetrahydrofuran (38 parts by mass). After this, an acrylic resin (ACRYDIC BZ1161, 40% by mass solid content, manufactured by DIC Corporation) (3.9 parts by mass), a silicone compound (ACRYDIC A9585, 80% by mass solid content, manufactured by DIC Corporation) (0.8 parts by mass), and the charge transporting material having the structural formula (2) above (1 part by mass) were added thereto, and the resultant was irradiated with ultrasonic waves for 5 minutes, to thereby obtain a preparation A.

Next, cyclohexanone (7 parts by mass) was added to aluminum oxide (SUMICORUNDUM AA-03, manufactured by Sumitomo Chemical Co., Ltd., average primary particle diameter of 0.3 μm) (3 parts by mass), and the resultant was subjected to dispersion for 12 hours with a ball mill using alumina balls as media. The obtained dispersion liquid was mixed and stirred with the preparation A to obtain a protection layer coating liquid.

The charge transporting layer was coated with this protection layer coating liquid by spray coating. The resultant base was left for 1 minute while being rotated so as to be dried until the surface was not wet when touched by a finger (set to touch). After this, the resultant was subjected to thermal curing at 150° C. for 20 minutes to form a protection layer having a thickness of 5.0 to thereby obtain an electrophotographic photoconductor.

Examples 2, 3, and 4, and Comparative Examples 1 and 2

An electrophotographic photoconductor was manufactured in the same manner as Example 1, except that the production of the protection layer coating liquid was changed as shown in Table 1 below. Table 1 also show d(1)/d(2), metal oxide content, and CXS3031P/AA-03.

TABLE 1

| | CXS303IP | AA-03 | d(1)/d(2) | Metal oxide content | CXS303IP/AA-03 |
|---|---|---|---|---|---|
| Example 1 | 8.50 | 3.00 | 0.1 | 65.2 | 0.85 |
| Example 2 | 3.20 | 4.59 | 0.1 | 65.2 | 0.21 |
| Example 3 | 13.50 | 1.50 | 0.1 | 65.2 | 2.70 |
| Example 4 | 15.20 | 0.95 | 0.1 | 65.2 | 4.80 |
| Comparative Example 1 | 18.50 | 0.00 | 0.1 | 65.2 | — |
| Comparative Example 2 | 0.00 | 5.55 | 0.1 | 65.2 | 0 |

*Comparative Example 1 used only CXS303IP, and Comparative Example 2 used only AA-03

The electrophotographic photoconductors of Examples 1 to 4 and Comparative Examples 1 and 2 manufactured in the way described above were attached to the electrophotographic process cartridge of a digital full-color multi-functional machine (IMAGIO MP C3500 manufactured by Ricoh Company Ltd.). The contact pressure of the cleaning blade was changed to 2.3 times as large as the original contact pressure, the voltage of the charging device was adjusted such that the dark space potential (VD) would become −700 V, and the light volume of LD was adjusted such that the light space potential (VL) would become −100 V. After printing was performed on 400,000 sheets serially, the dark space potential, the light space potential, and the image quality were evaluated.

Evaluations were as follows.

Dark space potential: the potential of the surface of the photoconductor when the photoconductor came to the position of the developing unit after it was charged for the first time Light space potential: the potential of the surface of the photoconductor when the photoconductor came to the position of the developing unit after it was charged for the first time and received image exposure (whole surface exposure)

Image quality: image density, thin line reproducibility, character blur, resolution, and background smear of the output images were totally evaluated.

Further, after serial printing on 400,000 sheets was completed, thickness measurement was performed to evaluate the amount of wear based on the difference between the thickness before printing and the thickness after printing. The results are shown in Table 2.

The thickness of the photoconductor was measured with an eddy current film thickness meter manufactured by Fischer (the same applies hereinafter).

TABLE 2

| | Initially | | | After printing on 400,000 sheets | | | |
|---|---|---|---|---|---|---|---|
| | VD (−V) | VL (−V) | Image quality | VD (−V) | VL (−V) | Image quality | Wear amount (μm) |
| Example 1 | 600 | 100 | fine | 595 | 95 | fine | 1.4 |
| Example 2 | 600 | 100 | fine | 600 | 105 | fine | 1.1 |
| Example 3 | 600 | 100 | fine | 585 | 95 | fine | 1.7 |
| Example 4 | 600 | 100 | fine | 580 | 90 | fine | 2.5 |
| Comparative Example 1 | 600 | 100 | fine | 400 | 150 | heavy background smear | ≥5.0 |
| Comparative Example 2 | 600 | 100 | fine | 620 | 280 | image density degraded | 1.0 |

*Comparative Example 1 lost the protection layer completely by wear and allowed wear to go into the charge transporting layer.

Example 5

An alkyd resin (BECKOLITE M-6401-50, 50% by mass solid content, manufactured by DIC Corporation) (18 parts by mass), and a melamine resin (SUPERBECKAMINE L-145-60, 60% by mass solid content, manufactured by DIC Corporation) (10 parts by mass) were dissolved in methyl ethyl ketone (80 parts by mass).

Titanium oxide (CR-EL manufactured by Ishihara Sangyo Kaisha, Ltd.) (55 parts by mass) and PT-401M (manufactured by Ishihara Sangyo Kaisha Ltd.) (20 parts by mass) were added thereto, and the resultant was subjected to dispersion for 36 hours with a ball mill using alumina balls as media, to thereby obtain an intermediate layer coating liquid.

An aluminum drum having a diameter of 40 mm and a length of 346 mm was coated with the obtained liquid, dried for 20 minutes at 130° C., to thereby form an intermediate layer with a thickness of 2.5 μm.

Next, an azo pigment having the structural formula (I) given above (24.0 parts by mass) and a τ-type metal-free phthalocyanine pigment (TPA-891 manufactured by Toyo Ink Co., Ltd.) (12.0 parts by mass) were subjected to dispersion in methyl ethyl ketone (330 parts by mass) for 168 hours with a ball mill. After the dispersion, a resin liquid obtained by dissolving polyvinyl butyral (S-LEC BL-1 manufactured by Sekisui Chemical Co., Ltd.) (12 parts by mass) in methyl ethyl ketone (390 parts by mass) and cyclohexanone (1,680 parts by mass) was added thereto, and the resultant was subjected to dispersion for 5 hours.

The intermediate layer was coated with the charge generating layer coating liquid obtained in this way by immersion and dried for 20 minutes at 130° C., to thereby form a charge generating layer with a thickness of about 0.3 μm.

Next, a charge transporting layer coating liquid was produced by dissolving a charge transporting material represented by a structural formula (3) below (10 parts by mass), a polycarbonate resin with a bisphenol A type structure (PAN- LITE C1400 manufactured by Teijin Chemicals Ltd.) (10 parts by mass), and a silicone oil KF-50 (manufactured by Shin-Etsu Chemical Co., Ltd.) (0.02 parts by mass) in tetrahydrofuran (77 parts by mass).

The charge generating layer was coated with the produced charged transporting layer coating liquid by immersion immediately after the liquid was produced. Then, the coated liquid was dried for 20 minutes at 135° C., to form a charge transporting layer with a thickness of 20 μm.

Structural formula (3)

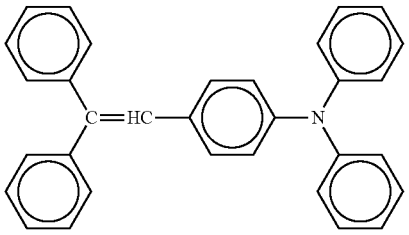

Next, titanium oxide (TTO-51, manufactured by Ishihara Sangyo Kaisha Ltd., average primary particle diameter of 0.02 μm) (3 parts by mass) was added to cyclohexanone (15 parts by mass) and tetrahydrofuran (38 parts by mass). After this, an acrylic resin (ACRYDIC BZ1160, 40% by mass solid content, manufactured by DIC Corporation) (3.9 parts by mass), a silicone compound (ACRYDIC A9585, 80% by mass solid content, manufactured by DIC Corporation) (0.5 parts by mass), and the charge transporting material having the structural formula (3) above (1.2 parts by mass) were added thereto, and the resultant was subjected to dispersion for 12 hours with a ball mill using alumina balls as media, to thereby obtain a preparation B.

Next, cyclohexanone (7 parts by mass) was added to titanium oxide (CR-EL, manufactured by Ishihara Sangyo Kaisha Co., Ltd., average primary particle diameter of 0.25 μm) (3 parts by mass), and the resultant was subjected to dispersion for 12 hours with a ball mill using alumina balls as media. The obtained dispersion liquid was mixed and stirred with the preparation B to obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 150° C. for 20 minutes to form a protection layer having a thickness of 7.0 μm, to thereby obtain an electrophotographic photoconductor.

Example 6

A photoconductor was manufactured in the same manner as Example 5, except that the metal oxide to be added in the production of the preparation B was changed to conductive Sb-doped tin oxide (SN-100P, manufactured by Ishihara Sangyo Kaisha Co., Ltd., average primary particle diameter of 0.02 μm).

Example 7

A photoconductor was manufactured in the same manner as Example 5, except that titanium oxide to be added in the production of the titanium oxide dispersion liquid to be added to the protection layer preparation B of Example 5 was changed to titanium oxide (PT-501A, manufactured by Ishihara Sangyo Kaisha Co., Ltd., average primary particle diameter of 0.10 μm).

Comparative Example 3

A photoconductor was manufactured in the same manner as

Example 5, except that titanium oxide to be added in the production of the titanium oxide dispersion liquid to be added to the protection layer preparation B of Example 5 was changed to titanium oxide (PT-401W, manufactured by Ishihara Sangyo Kaisha Co., Ltd., average primary particle diameter of 0.07 μm).

The constitutional contents of the protection layers of Examples 5 to 7 and Comparative Example 3 were as shown in Table 3 below.

TABLE 3

| | d(1)/d(2) | Metal oxide content | Particle diameter (small)/particle diameter (large) |
|---|---|---|---|
| Example 5 | 0.08 | 65.5 | 1.00 |
| Example 6 | 0.08 | 65.5 | 1.00 |
| Example 7 | 0.25 | 65.5 | 1.00 |
| Comparative Example 3 | 0.29 | 65.5 | 1.00 |

The electrophotographic photoconductors of Examples 5 to 7 and Comparative Example 3 manufactured in the way described above were attached to the electrophotographic process cartridge of a digital full-color printer (IPSIO SP C811 manufactured by Ricoh Company Ltd.) of which image exposure light source was changed to a 780 nm LD. The voltage of the charging device was adjusted such that the dark space potential (VD) would become −700 V at a temperature of 25° C. and a humidity of 50% RH, and the light volume of the LD was adjusted such that the light space potential (VL) would become −120 V. The contact pressure of the cleaning blade was changed to 1.5 times as large as the original contact pressure.

Under the conditions described above, printing was performed on 100,000 sheets at 25° C./50% RH, on 100,000 sheets at 15° C./20% RH, and on 100,000 sheets at 30° C./90% RH. The internal potential and thickness of the used apparatus were measured after printing on 100,000 sheets at each set of conditions, and the amount of wear was evaluated based on the difference between the thickness before printing and the thickness after printing. The results are shown in Table 4 below.

TABLE 4

| | Initially at 25° C./50% RH | | After printing on 100,000 sheets at 25° C./50% RH | | After printing on 100,000 sheets at 15° C./20% RH | | After printing on 100,000 sheets at 30° C./90% RH | | After printing on 300,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 5 | 700 | 120 | 700 | 125 | 695 | 135 | 690 | 135 | 0.9 |
| Example 6 | 700 | 120 | 700 | 120 | 695 | 125 | 690 | 120 | 0.9 |

TABLE 4-continued

| | Initially at 25° C./ 50% RH | | After printing on 100,000 sheets at 25° C./ 50% RH | | After printing on 100,000 sheets at 15° C./ 20% RH | | After printing on 100,000 sheets at 30° C./ 90% RH | | After printing on 300,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 7 | 700 | 120 | 700 | 120 | 685 | 125 | 675 | 120 | 2.3 |
| Comparative Example 3 | 700 | 120 | 600 | 125 | 530 | 140 | 480 | 145 | 4.5 |

Example 8

The aluminum drum of Example 1 was changed to a diameter of 30 mm and a length of 340 mm, and the protection layer of Example 1 was changed to the prescription below.

A polycarbonate resin having a bisphenol Z type structure (PANLITE TS2050 manufactured by Teijin Chemicals Ltd.) (2 parts by mass) was dissolved in cyclohexanone (9 parts by mass) and tetrahydrofuran (36 parts by mass). Then, zinc oxide (FZO-50, manufactured by Ishihara Sangyo Kaisha Co., Ltd., average primary particle diameter of 0.021 μm) (2.6 parts by mass) was added to the obtained dissolution liquid, and the resultant was subjected to dispersion for 12 hours with a ball mill using alumina balls as media. After this, a charge transporting material having the structural formula (2) given above (1.4 parts by mass) was added to the resultant, to thereby obtain a preparation C.

Next, cyclohexanone (7 parts by mass) was added to aluminum oxide (SUMICORUNDUM AA-03, manufactured by Sumitomo Chemical Co., Ltd., average primary particle diameter of 0.4 μm) (2.6 parts by mass), and the resultant was subjected to dispersion for 12 hours with a ball mill using alumina balls as media. The obtained dispersion liquid was mixed and stirred with the preparation C, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 135° C. for 20 minutes to form a protection layer having a thickness of 10.0 μM.

Comparative Example 4

A photoconductor was manufactured in the same manner as Example 8, except that in the production of the protection layer coating liquid of Example 8, zinc oxide (FZO-50) was changed to 1.5 parts by mass, the polycarbonate resin having a bisphenol Z type structure (PANLITE TS2050) was changed to 2.5 parts by mass, the charge transporting material having the structural formula (2) was changed to 1.75 parts by mass, and aluminum oxide (AA-03) was changed to 1.5 parts by mass.

Comparative Example 5

A photoconductor was manufactured in the same manner as Example 8, except that in the production of the protection layer coating liquid of Example 8, zinc oxide (FZO-50) was changed to 1.0 part by mass, the polycarbonate resin having a bisphenol Z type structure (PANLITE TS2050) was changed to 3.0 parts by mass, the charge transporting material having the structural formula (2) was changed to 2.1 parts by mass, and aluminum oxide (AA-03) was changed to 1.0 part by mass.

The constitutional contents of the protection layers of each of Example and Comparative Examples were as shown in Table 5 below.

TABLE 5

| | d(1)/d(2) | Metal oxide content | Particle diameter (small)/particle diameter (large) |
|---|---|---|---|
| Example 8 | 0.07 | 60.5 | 1.00 |
| Comparative Example 4 | 0.07 | 41.4 | 1.00 |
| Comparative Example 5 | 0.07 | 28.2 | 1.00 |

The electrophotographic photoconductors of Example 8 and Comparative Examples 4 and 5 manufactured in the way described above were attached to the electrophotographic process cartridge of a digital full-color printer (IPSIO COLOR 8100 manufactured by Ricoh Company Ltd.). The voltage of the charging device was adjusted such that the dark space potential (VD) would become −850 V, and the light volume of LD was adjusted such that the light space potential (VL) would become −150 V.

After this, printing was performed on 100,000 sheets serially at a temperature of 25° C. and a humidity of 50% RH, and thickness measurement was performed to evaluate the amount of wear based on the difference between the thickness before printing and the thickness after printing. The results are shown in Table 6 below.

TABLE 6

| | Initially | | After printing on 100,000 sheets | | |
|---|---|---|---|---|---|
| | VD (−V) | VL (−V) | VD (−V) | VL (−V) | Wear amount (μm) |
| Example 8 | 850 | 150 | 840 | 155 | 1.0 |
| Comparative Example 4 | 850 | 150 | 600 | 185 | 5.0 |
| Comparative Example 5 | 850 | 150 | 500 | 230 | 8.0 |

Example 11

The process up to the formation of a charge transporting layer was performed in the same manner as Example 1, and a protection layer was manufactured in the manner described below.

Next, conductive phosphorus-doped tin oxide (CELNAX CXS3031P, 30% by mass solid content, manufactured by Nissan Chemical Industries, Ltd., average primary particle diameter of 0.03 μm) (9.0 parts by mass) was diluted with isopropyl alcohol (7.5 parts by mass), cyclohexanone (7.5 parts by mass), and tetrahydrofuran (38 parts by mass). After this, an acrylic resin (ACRYDIC SZ1161, 40% by mass solid content, manufactured by DIC Corporation) (5.4 parts by mass), a silicone compound (ACRYDIC A9585, 80% by mass solid content, manufactured by DIC Corporation) (0.8 parts by mass), and the charge transporting material having the structural formula (2) above (1.1 parts by mass) were added thereto, and the resultant was irradiated with ultrasonic waves for 5 minutes, to thereby obtain a preparation A2.

Next, a high-molecular compound having a carboxyl group (DISPERBYK-P 105, 98.5% by mass solid content, manufactured by BYK-Chemie Japan K.K.) (0.5 parts by mass), toluene (3.5 parts by mass), and cyclohexanone (3.5 parts by mass) were added to aluminum oxide (SUMICORUNDUM AA-03, manufactured by Sumitomo Chemical Co., Ltd., average primary particle diameter of 0.3 μm) (4 parts by mass), and the resultant was subjected to dispersion for 12 hours with a ball mill using alumina balls as media. The obtained dispersion liquid was mixed and stirred with the preparation A2, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 135° C. for 20 minutes to form a protection layer having a thickness of 6.0 μm, to thereby manufacture an electrophotographic photoconductor.

Examples 12, 13, and 14, and Comparative Examples 11 and 12

Electrophotographic photoconductors were manufactured in the same manner as Example 11, except that the production of the protection layer coating liquid of Example 11 was changed as shown in Table 7 below. Table 7 also shows d(1)/d(2), metal oxide content, and CXS3031P/AA-03.

TABLE 7

| | CXS303IP | AA-03 | d(1)/d(2) | Metal oxide content | CXS303IP/AA-03 |
|---|---|---|---|---|---|
| Example 11 | 9.00 | 4.00 | 0.1 | 60.4 | 0.68 |
| Example 12 | 3.70 | 5.59 | 0.1 | 60.4 | 0.20 |
| Example 13 | 14.00 | 2.50 | 0.1 | 60.4 | 1.68 |
| Example 14 | 15.70 | 1.99 | 0.1 | 60.4 | 2.37 |
| Comparative Example 11 | 22.34 | 0.00 | 0.1 | 60.4 | — |
| Comparative Example 12 | 0.00 | 6.70 | 0.1 | 60.4 | 0 |

*Comparative Example 11 used only CXS303IP, and Comparative Example 12 used only AA-03

The electrophotographic photoconductors of Examples 11 to 14 and Comparative Examples 11 and 12 manufactured in the way described above were attached to the electrophotographic process cartridge of a digital full-color multi-functional machine (IMAGIO MP C3500 manufactured by Ricoh Company Ltd.). The contact pressure of the cleaning blade was changed to 2.3 times as large as the original contact pressure, the voltage of the charging device was adjusted such that the dark space potential (VD) would become −650 V, and the light volume of LD was adjusted such that the light space potential (VL) would become −80 V. After printing was performed on 500,000 sheets serially, the dark space potential, the light space potential, and the image quality were evaluated.

Evaluations were as follows.

Dark space potential: the potential of the surface of the photoconductor when the photoconductor came to the position of the developing unit after it was charged for the first time Light space potential: the potential of the surface of the photoconductor when the photoconductor came to the position of the developing unit after it was charged for the first time and received image exposure (whole surface exposure)

Image quality: image density, thin line reproducibility, character blur, resolution, and background smear of the output images were totally evaluated.

Further, after serial printing on 500,000 sheets was completed, thickness measurement was performed to evaluate the amount of wear based on the difference between the thickness before printing and the thickness after printing. The results are shown in Table 8 below.

TABLE 8

| | Initially | | | After printing on 500,000 sheets | | | |
|---|---|---|---|---|---|---|---|
| | VD (−V) | VL (−V) | Image quality | VD (−V) | VL (−V) | Image quality | Wear amount (μm) |
| Example 11 | 650 | 80 | fine | 648 | 78 | fine | 1.0 |
| Example 12 | 650 | 80 | fine | 648 | 87 | fine | 1.0 |
| Example 13 | 650 | 80 | fine | 638 | 77 | fine | 1.4 |
| Example 14 | 650 | 80 | fine | 635 | 73 | fine | 2.0 |
| Comparative Example 11 | 650 | 80 | fine | 450 | 130 | heavy background smear | ≥5.0 |
| Comparative Example 12 | 650 | 80 | fine | 700 | 220 | image density degraded | 2.5 |

*Comparative Example 11 lost the protection layer completely by wear and allowed wear to go into the charge transporting layer.

Example 15

The process up to the formation of a charge transporting layer was performed in the same manner as Example 5, and a protection layer was manufactured in the manner described below.

Next, titanium oxide (TTO-51, manufactured by Ishihara Sangyo Kaisha Co., Ltd., average primary particle diameter of 0.02 μm) (4.5 parts by mass), a compound having a carboxyl group (HOMOGENOL L-18, 40% by mass solid content, manufactured by Kao Corporation) (0.2 parts by mass), cyclohexanone (15 parts by mass), and tetrahydrofuran (38 parts by mass) were added together. An acrylic resin (ACRYDIC BZ1160, 40% by mass solid content, manufactured by DIC Corporation) (4.5 parts by mass), a silicone compound (ACRYDIC 9585, 80% by mass solid content, manufactured by DIC Corporation) (0.6 parts by mass), and the charge transporting material having the structural formula (3) given above (1.6 parts by mass) were further added thereto, and the resultant was subjected to dispersion for 12 hours with a ball mill using alumina balls as media, to thereby obtain a preparation B2.

Next, cyclohexanone (7 parts by mass) was added to titanium oxide (CR-EL, manufactured by Ishihara Sangyo Kaisha Co., Ltd., average primary particle diameter of 0.25 μm) (4.5 parts by mass) and a compound having a carboxyl group (HOMOGENOL L-1820, 20% by mass solid content, manufactured by Kao Corporation) (0.2 parts by mass), and the resultant was subjected to dispersion for 12 hours with a ball mill using alumina balls as media. The obtained dispersion liquid was mixed and stirred with the preparation B2, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 165° C. for 20 minutes to form a protection layer having a thickness of 5.0 μm, to thereby obtain an electrophotographic photoconductor.

Example 16

A photoconductor was manufactured in the same manner as Example 15, except that the metal oxide to be added in the production of the preparation B2 was changed to conductive Sb-doped tin oxide (SN-100P, manufactured by Ishihara Sangyo Kaisha Co., Ltd., average primary particle diameter of 0.02 μm).

Example 17

A photoconductor was manufactured in the same manner as Example 15, except that titanium oxide to be added to a titanium oxide dispersion liquid to be added to the protection layer preparation B2 of Example 15 was changed to titanium oxide (ET-300W, manufactured by Ishihara Sangyo Kaisha Co., Ltd., average primary particle diameter of 0.045 μm).

Comparative Example 13

A photoconductor was manufactured in the same manner as Example 15, except that titanium oxide to be added to a titanium oxide dispersion liquid to be added to the protection layer preparation B2 of Example 15 was changed to titanium oxide (PT-401W, manufactured by Ishihara Sangyo Kaisha Co., Ltd., average primary particle diameter of 0.07 μm).

The constitutional contents of the protection layers of Examples 15 to 17 and Comparative Example 13 were as shown in Table 9 below.

TABLE 9

| | d(1)/d(2) | Metal oxide content | Particle diameter (small)/particle diameter (large) |
|---|---|---|---|
| Example 15 | 0.08 | 69.4 | 1.00 |
| Example 16 | 0.08 | 69.4 | 1.00 |
| Example 17 | 0.18 | 69.4 | 1.00 |
| Comparative Example 13 | 0.28 | 69.4 | 1.00 |

The electrophotographic photoconductors of Examples 15 to 17 and Comparative Example 13 manufactured in the way described above were attached to the electrophotographic process cartridge of a digital full-color printer (IPSIO SP C811 manufactured by Ricoh Company Ltd.) of which image exposure light source was changed to a 780 nm LD. The voltage of the charging device was adjusted such that the dark space potential (VD) would become −680 V at a temperature of 25° C. and a humidity of 50% RH, and the light volume of the LD was adjusted such that the light space potential (VL) would become −100 V. The contact pressure of the cleaning blade was changed to 1.5 times as large as the original contact pressure.

Under the conditions described above, printing was performed on 120,000 sheets at 25° C./50% RH, on 120,000 sheets at 15° C./20% RH, and on 120,000 sheets at 30° C./90% RH. The internal potential and thickness of the used apparatus were measured after printing on 120,000 sheets at each set of conditions, and the amount of wear was evaluated based on the difference between the thickness before printing and the thickness after printing. The results are shown in Table 10 below.

TABLE 10

| | Initially at 25° C./50% RH | | After printing on 120,000 sheets at 25° C./50% RH | | After printing on 120,000 sheets at 15° C./20% RH | | After printing on 120,000 sheets at 30° C./90% RH | | After printing on 360,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 15 | 680 | 100 | 680 | 125 | 685 | 135 | 680 | 125 | 0.7 |
| Example 16 | 680 | 100 | 675 | 100 | 685 | 110 | 670 | 105 | 0.7 |

TABLE 10-continued

| | Initially at 25° C./ 50% RH | | After printing on 120,000 sheets at 25° C./ 50% RH | | After printing on 120,000 sheets at 15° C./ 20% RH | | After printing on 120,000 sheets at 30° C./ 90% RH | | After printing on 360,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 17 | 680 | 100 | 675 | 100 | 685 | 115 | 655 | 110 | 1.8 |
| Comparative Example 13 | 680 | 100 | 580 | 125 | 520 | 140 | 470 | 155 | 4.5 |

Example 18

In Example 11, the aluminum drum was changed to a diameter of 30 mm and a length of 340 mm, and the protection layer was changed to the following prescription.

A polycarbonate resin having a bisphenol Z type structure (PANLITE TS2050 manufactured by Teijin Chemicals Ltd.) (2 parts by mass) was dissolved in cyclohexanone (9 parts by mass) and tetrahydrofuran (36 parts by mass). Next, zinc oxide (FZO-50, manufactured by Ishihara Sangyo Kaisha Co., Ltd., average primary particle diameter of 0.021 μm) (3.0 parts by mass) was added to the obtained dissolution liquid, and the resultant was subjected to dispersion for 12 hours with a ball mill using alumina balls as media. After this, a charge transporting material having the structural formula (2) given above (1.44 parts by mass) was dissolved in the dispersion liquid, to thereby obtain a preparation C2.

Next, toluene (3.5 parts by mass) and cyclohexanone (3.5 parts by mass) were added to aluminum oxide (SUMICORUNDUM AA-03, manufactured by Sumitomo Chemical Co., Ltd., average primary particle diameter of 0.4 μm) (3.0 parts by mass) and a dispersant containing a carboxyl group (DISPARLON DA-1200, 75% by mass solid content, manufactured by Kusumoto Chemicals, Ltd.) (0.5 parts by mass), and the resultant was subjected to dispersion for 12 hours with a ball mill using alumina balls as media. The obtained dispersion liquid was mixed and stirred with the preparation C2, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 125° C. for 20 minutes to form a protection layer having a thickness of 7.0 μm.

Comparative Example 14

A photoconductor was manufactured in the same manner as Example 18, except that in the production of the protection layer coating liquid of Example 18, zinc oxide (FZO-50) was changed to 0.5 parts by mass, the polycarbonate resin having a bisphenol Z type structure (PANLITE TS2050) was changed to 2.5 parts by mass, the charge transporting material having the structural formula (2) given above was changed to 1.8 parts by mass, and aluminum oxide (AA-03) was changed to 1.3 parts by mass.

Comparative Example 15

A photoconductor was manufactured in the same manner as Example 18, except that in the production of the protection layer coating liquid of Example 18, zinc oxide (FZO-50) was changed to 0.5 parts by mass, the polycarbonate resin having a bisphenol Z type structure (PANLITE TS2050) was changed to 3.0 parts by mass, the charge transporting material having the structural formula (2) given above was changed to 2.16 parts by mass, and aluminum oxide (AA-03) was changed to 0.5 parts by mass.

The constitutional contents of the protection layers of each example and comparative example were as shown in Table 11 below.

TABLE 11

| | d(1)/d(2) | Metal oxide content | Particle diameter (small)/particle diameter (large) |
|---|---|---|---|
| Example 18 | 0.05 | 61.1 | 1.00 |
| Comparative Example 14 | 0.05 | 35.7 | 1.00 |
| Comparative Example 15 | 0.05 | 15.3 | 1.00 |

The electrophotographic photoconductors of Example 18 and Comparative Examples 14 and 15 manufactured in the way described above were attached to the electrophotographic process cartridge of a digital full-color printer (IPSIO COLOR 8100 manufactured by Ricoh Company Ltd.). The voltage of the charging device was adjusted such that the dark space potential (VD) would become −900 V, and the light volume of LD was adjusted such that the light space potential (VL) would become −150 V.

After this, printing was performed on 130,000 sheets serially at a temperature of 25° C. and a humidity of 50% RH, and thickness measurement was performed to evaluate the amount of wear based on the difference between the thickness before printing and the thickness after printing. The results are shown in Table 12 below.

TABLE 12

| | Initially | | After printing on 130,000 sheets | | |
|---|---|---|---|---|---|
| | VD (−V) | VL (−V) | VD (−V) | VL (−V) | Wear amount (μm) |
| Example 18 | 900 | 150 | 880 | 155 | 0.7 |
| Comparative Example 14 | 900 | 150 | 600 | 195 | 5.5 |
| Comparative Example 15 | 900 | 150 | 500 | 250 | 9.0 |

Example 21

The process up to the formation of a charge transporting layer was performed in the same manner as Example 1, and a protection layer was manufactured in the manner described below.

Next, conductive phosphorus-doped tin oxide (CELNAX CXS3031P, 30% by mass solid content, manufactured by Nissan Chemical Industries, Ltd., average primary particle diameter of 0.03 μm) (8.5 parts by mass) was diluted with cyclohexanone (18 parts by mass) and tetrahydrofuran (35 parts by mass). After this, an acrylic resin (ACRYDIC BZ1161, 44% by mass solid content, manufactured by DIC Corporation) (5.0 parts by mass), a silane coupling agent (KBM-502, Shin-Etsu Chemical Co., Ltd.) (0.8 parts by mass), and a charge transporting material having the structural formula (2) given above (1.2 parts by mass) were added thereto, and the resultant was irradiated with ultrasonic waves for 5 minutes, to thereby obtain a preparation A3.

Next, cyclohexanone (7.8 parts by mass) was added to aluminum oxide (SUMICORUNDUM AA-03, manufactured by Sumitomo Chemical Co., Ltd., average primary particle diameter of 0.3 μm) (3.0 parts by mass), and the resultant was subjected to dispersion for 12 hours with a ball mill using alumina balls as media. The obtained dispersion liquid was mixed and stirred with the preparation A3, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 150° C. for 20 minutes to form a protection layer having a thickness of 5.0 μm, to thereby obtain an electrophotographic photoconductor.

Examples 22, 23, and 24, and Comparative Examples 21 and 22

Electrophotographic photoconductors were manufactured in the same manner as Example 21, except that the production of the protection layer coating liquid of Example 21 was changed as shown in Table 13 below. Table 13 also shows d(1)/d(2), metal oxide content, and CXS3031P/AA-03.

TABLE 13

| | CXS303IP | AA-03 | d(1)/d(2) | Metal oxide content | CXS303IP/AA-03 |
|---|---|---|---|---|---|
| Example 21 | 8.50 | 3.00 | 0.1 | 56.9 | 0.85 |
| Example 22 | 3.20 | 4.59 | 0.1 | 56.9 | 0.21 |
| Example 23 | 13.50 | 1.50 | 0.1 | 56.9 | 2.70 |
| Example 24 | 15.20 | 0.96 | 0.1 | 56.9 | 4.80 |
| Comparative Example 21 | 18.50 | 0.00 | 0.1 | 56.9 | — |
| Comparative Example 22 | 0.00 | 5.55 | 0.1 | 56.9 | 0 |

*Comparative Example 21 used only CXS303IP, and Comparative Example 22 used only AA-03

The electrophotographic photoconductors of Examples 21 to 24 and Comparative Examples 21 and 22 manufactured in the way described above were attached to the electrophotographic process cartridge of a digital full-color multi-functional machine (IMAGIO MP C3500 manufactured by Ricoh Company Ltd.). The contact pressure of the cleaning blade was changed to 2.2 times as large as the original contact pressure, the voltage of the charging device was adjusted such that the dark space potential (VD) would become −620 V, and the light volume of LD was adjusted such that the light space potential (VL) would become −100 V. After printing was performed on 500,000 sheets serially, the dark space potential, the light space potential, and the image quality were evaluated.

Evaluations were as follows.

Dark space potential: the potential of the surface of the photoconductor when the photoconductor came to the position of the developing unit after it was charged for the first time Light space potential: the potential of the surface of the photoconductor when the photoconductor came to the position of the developing unit after it was charged for the first time and received image exposure (whole surface exposure)

Image quality: image density, thin line reproducibility, character blur, resolution, and background smear of the output images were totally evaluated.

Further, after serial printing on 500,000 sheets was completed, thickness measurement was performed to evaluate the amount of wear based on the difference between the thickness before printing and the thickness after printing. The results are shown in Table 14.

TABLE 14

| | Initially | | | After printing on 500,000 sheets | | | |
|---|---|---|---|---|---|---|---|
| | VD (−V) | VL (−V) | Image quality | VD (−V) | VL (−V) | Image quality | Wear amount (μm) |
| Example 21 | 620 | 100 | fine | 615 | 95 | fine | 1.3 |
| Example 22 | 620 | 100 | fine | 620 | 105 | fine | 1.1 |
| Example 23 | 620 | 100 | fine | 605 | 95 | fine | 1.6 |
| Example 24 | 620 | 100 | fine | 600 | 90 | fine | 2.4 |
| Comparative Example 21 | 620 | 100 | fine | 420 | 150 | heavy background smear | ≥5.0 |
| Comparative Example 22 | 620 | 100 | fine | 650 | 280 | image density degraded | 1.0 |

*Comparative Example 21 lost the protection layer completely by wear and allowed wear to go into the charge transporting layer.

Example 25

The process up to the formation of a charge transporting layer was performed in the same manner as Example 5, and a protection layer was manufactured in the manner described below.

Next, titanium oxide (TTO-51, manufactured by Ishihara Sangyo Kaisha Co., Ltd., average primary particle diameter of 0.02 μm) (3.0 parts by mass), cyclohexanone (15 parts by mass), and tetrahydrofuran (38 parts by mass) were added together, and an acrylic resin (ACRYDIC BZ1160, 44% by mass solid content, manufactured by DIC Corporation) (3.9 parts by mass), a silane coupling agent (Z6040 manufactured by Dow Corning Toray Co., Ltd.) (0.5 parts by mass), and a charge transporting material having the structural formula (3) given above (1.2 parts by mass) were further added thereto. The resultant was subjected to dispersion for 12 hours with a ball mill using alumina balls as media, to thereby obtain a preparation B3.

Next, titanium oxide (CR-EL, manufactured by Ishihara Sangyo Kaisha Co., Ltd., average primary particle diameter of 0.25 μm) (3.0 parts by mass) and cyclohexanone (7 parts by mass) were added together, and the resultant was subjected to dispersion for 12 hours with a ball mill using alumina balls as media. The obtained dispersion liquid was mixed and stirred with the preparation B3, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 155° C. for 20 minutes to form a protection layer having a thickness of 6.5 μm, to thereby obtain an electrophotographic photoconductor.

Example 26

A photoconductor was manufactured in the same manner Example 25, except that the metal oxide to be added in the production of the preparation B3 was changed to conductive Sb-doped tin oxide (SN-100P, manufactured by Ishihara Sangyo Kaisha Co., Ltd, average primary particle diameter of 0.02 μm).

Example 27

A photoconductor was manufactured in the same manner as Example 25, except that titanium oxide to be added to the titanium oxide dispersion liquid to be added to the protection layer preparation B3 of Example 25 was changed to titanium oxide (ET-300W, manufactured by Ishihara Sangyo Kaisha Co., Ltd., average primary particle diameter of 0.045 μm).

Comparative Example 23

A photoconductor was manufactured in the same manner as Example 25, except that titanium oxide to be added to the titanium oxide dispersion liquid to be added to the protection layer preparation B3 of Example 25 was changed to titanium oxide (PT-401W, manufactured by Ishihara Sangyo Kaisha Co., Ltd., average primary particle diameter of 0.07 μm).

The constitutional contents of the protection layers of Examples 25 to 27 and Comparative Example 23 were as shown in Table 15 below.

TABLE 15

| | d(1)/d(2) | Metal oxide content | Particle diameter (small)/particle diameter (large) |
|---|---|---|---|
| Example 25 | 0.08 | 63.7 | 1.00 |
| Example 26 | 0.08 | 63.7 | 1.00 |
| Example 27 | 0.18 | 63.7 | 1.00 |
| Comparative Example 23 | 0.28 | 63.7 | 1.00 |

The electrophotographic photoconductors of Examples 25 to 27 and Comparative Example 23 manufactured in the way described above were attached to the electrophotographic process cartridge of a digital full-color printer (IPSIO SP C811 manufactured by Ricoh Company Ltd.) of which image exposure light source was changed to a 780 nm LD. The voltage of the charging device was adjusted such that the dark space potential (VD) would become −710 V at a temperature of 25° C. and a humidity of 50% RH, and the light volume of the LD was adjusted such that the light space potential (VL) would become −125 V. The contact pressure of the cleaning blade was changed to 1.5 times as large as the original contact pressure.

Under the conditions described above, printing was performed on 110,000 sheets at 25° C./50% RH, on 110,000 sheets at 15° C./20% RH, and on 110,000 sheets at 30° C./90% RH. The internal potential and thickness of the used apparatus were measured after printing on 110,000 sheets at each set of conditions, and the amount of wear was evaluated based on the difference between the thickness before printing and the thickness after printing. The results are shown in Table 16 below.

TABLE 16

| | Initially at 25° C./ 50% RH | | After printing on 110,000 sheets at 25° C./ 50% RH | | After printing on 110,000 sheets at 15° C./ 20% RH | | After printing on 110,000 sheets at 30° C./ 90% RH | | After printing on 330,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 25 | 710 | 125 | 710 | 128 | 705 | 130 | 695 | 138 | 0.7 |
| Example 26 | 710 | 125 | 710 | 123 | 705 | 128 | 700 | 125 | 0.7 |
| Example 27 | 710 | 125 | 710 | 123 | 700 | 128 | 680 | 125 | 2.0 |
| Comparative Example 23 | 710 | 125 | 600 | 130 | 530 | 145 | 500 | 158 | 4.5 |

Example 28

In Example 21, the aluminum drum was changed to a diameter of 30 mm and a length of 340 mm, and the protection layer was changed to the following prescription.

An acrylic resin (ACRYDIC BZ1160-BA, 37% by mass solid content, manufactured by DIC Corporation) (3.7 parts by mass), and a silane coupling agent (KBM-5103 manufactured by Shin-Etsu Chemical Co., Ltd.) (0.52 parts by mass) were dissolved in cyclohexanone (9 parts by mass) and tetrahydrofuran (36 parts by mass). Next, zinc oxide (FZO-50, manufactured by Ishihara Sangyo Kaisha Co., Ltd., average primary particle diameter of 0.021 μm) (2.6 parts by mass) was added to the obtained dissolution liquid, and the resultant was subjected to dispersion for 12 hours with a ball mill using alumina balls as media. After this, a charge transporting material having the structural formula (2) given above (1.50 parts by mass) was dissolved in the obtained dispersion liquid, to thereby obtain a preparation C3.

Next, aluminum oxide (SUMICORUNDUM AA-03, manufactured by Sumitomo Chemical Co., Ltd., average primary particle diameter of 0.4 μm) (2.6 parts by mass) and cyclohexanone (7.0 parts by mass) were added together, and the resultant was subjected to dispersion for 12 hours with a ball mill using alumina balls as media. The obtained dispersion liquid was mixed and stirred with the preparation C3 to obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 150° C. for 15 minutes to form a protection layer having a thickness of 7.0 μm.

Comparative Example 24

A photoconductor was manufactured in the same manner as Example 28, except that in the production of the protection layer coating liquid of Example 28, the zinc oxide (FZO-50) was changed to 1.5 parts by mass, the acrylic resin (BZ1160-BA) was changed to 4.63 parts by mass, the silane coupling agent (KBM-5103) was changed to 0.65 parts by mass, the charge transporting material having the structural formula (2) was changed to 1.80 parts by mass, and the aluminum oxide (AA-03) was changed to 1.5 parts by mass.

Comparative Example 25

A photoconductor was manufactured in the same manner as Example 28, except that in the production of the protection layer coating liquid of Example 28, the zinc oxide (FZO-50) was changed to 1.0 part by mass, the acrylic resin (BZ1160-BA) was changed to 5.55 parts by mass, the silane coupling agent (KBM-5103) was changed to 0.78 parts by mass, the charge transporting material having the structural formula (2) was changed to 2.20 parts by mass, and the aluminum oxide (AA-03) was changed to 1.0 part by mass.

Reference Example 1

A photoconductor was manufactured in the same manner as Example 28, except that in the production of the protection layer coating liquid of Example 28, a polycarbonate resin having a bisphenol Z type structure (PANLITE TS2050 manufactured by Teijin Chemicals Ltd.) (1.89 parts by mass) was used instead of the acrylic resin and the silane coupling agent.

The constitutional contents of the protection layers of each example, comparative example, and reference example were as shown in Table 17 below.

TABLE 17

| | d(1)/d(2) | Metal oxide content | Particle diameter (small)/particle diameter (large) |
|---|---|---|---|
| Example 28 | 0.05 | 60.5 | 1.00 |
| Comparative Example 24 | 0.05 | 41.9 | 1.00 |
| Comparative Example 25 | 0.05 | 28.4 | 1.00 |
| Reference Example 1 | 0.05 | 60.5 | 1.00 |

The electrophotographic photoconductors of Example 28, Comparative Examples 24 and 25, and Reference Example 1 manufactured in the way described above were attached to the electrophotographic process cartridge of a digital full-color printer (IPSIO COLOR 8100 manufactured by Ricoh Company Ltd.). The voltage of the charging device was adjusted such that the dark space potential (VD) would become −820 V, and the light volume of LD was adjusted such that the light space potential (VL) would become −130 V.

After this, printing was performed on 120,000 sheets serially at a temperature of 25° C. and a humidity of 50% RH, and thickness measurement was performed to evaluate the amount of wear based on the difference between the thickness before printing and the thickness after printing. The results are shown in Table 18 below.

TABLE 18

| | Initially | | After printing on 120,000 sheets | | |
|---|---|---|---|---|---|
| | VD (−V) | VL (−V) | VD (−V) | VL (−V) | Wear amount (μm) |
| Example 28 | 820 | 130 | 815 | 130 | 0.7 |
| Comparative Example 24 | 820 | 130 | 570 | 170 | 5.5 |
| Comparative Example 25 | 820 | 130 | 480 | 220 | 9.0 |
| Reference Example 1 | 820 | 130 | 810 | 150 | 1.3 |

Example 31

The process up to the formation of a charge transporting layer was performed in the same manner as Example 1, and a protection layer was manufactured in the manner described below.

Next, conductive phosphorus-doped tin oxide (CELNAX CXS3031P, 30% by mass solid content, manufactured by Nissan Chemical Industries, Ltd., average primary particle diameter of 0.03 μm) (8.5 parts by mass) was diluted with cyclohexanone (18 parts by mass) and tetrahydrofuran (35 parts by mass). After this, an acrylic resin (ACRYDIC BZ1161, 44% by mass solid content, manufactured by DIC Corporation) (5.0 parts by mass), an alkoxy oligomer (X-40-2655A manufactured by Shin-Etsu Chemical Co., Ltd.) (0.8 parts by mass), and the charge transporting material having the structural formula (2) given above (1.2 parts by mass) were added thereto, and the resultant was irradiated with ultrasonic waves for 5 minutes, to thereby obtain a preparation A4.

Next, cyclohexanone (7.0 parts by mass) was added to aluminum oxide (SUMICORUNDUM AA-03, manufactured by Sumitomo Chemical Co., Ltd., average primary particle diameter of 0.3 μM) (3.0 parts by mass), and the resultant was subjected to dispersion for 12 hours with a ball mill using alumina balls as media. The obtained dispersion liquid was mixed and stirred with the preparation A4, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 150° C. for 20 minutes to form a protection layer having a thickness of 5.0 μm, to thereby obtain an electrophotographic photoconductor.

Examples 32, 33, and 34, and Comparative Examples 31 and 32 Electrophotographic photoconductors were manufactured in the same manner as Example 31, except that the production of the protection layer coating liquid of Example 31 was changed as shown in Table 19 below. Table 19 also shows d(1)/d(2), metal oxide content, and CXS3031P/AA-03.

TABLE 19

| | CXS303IP | AA-03 | d(1)/d(2) | Metal oxide content | CXS303IP/AA-03 |
|---|---|---|---|---|---|
| Example 31 | 8.50 | 3.00 | 0.1 | 56.9 | 0.85 |
| Example 32 | 3.20 | 4.59 | 0.1 | 56.9 | 0.21 |
| Example 33 | 13.50 | 1.50 | 0.1 | 56.9 | 2.70 |
| Example 34 | 15.20 | 0.96 | 0.1 | 56.9 | 4.80 |
| Comparative Example 31 | 18.50 | 0.00 | 0.1 | 56.9 | — |
| Comparative Example 32 | 0.00 | 5.55 | 0.1 | 56.9 | 0 |

*Comparative Example 31 used only CXS303IP, and Comparative Example 32 used only AA-03

The electrophotographic photoconductors of Examples 31 to 34 and Comparative Examples 31 and 32 manufactured in the way described above were attached to the electrophotographic process cartridge of a digital full-color multi-functional machine (IMAGIO MP C3500 manufactured by Ricoh Company Ltd.). The contact pressure of the cleaning blade was changed to twice as large as the original contact pressure, the voltage of the charging device was adjusted such that the dark space potential (VD) would become −610 V, and the light volume of LD was adjusted such that the light space potential (VL) would become −90 V. After printing was performed on 500,000 sheets serially, the dark space potential, the light space potential, and the image quality were evaluated.

Evaluations were as follows.

Dark space potential: the potential of the surface of the photoconductor when the photoconductor came to the position of the developing unit after it was charged for the first time Light space potential: the potential of the surface of the photoconductor when the photoconductor came to the position of the developing unit after it was charged for the first time and received image exposure (whole surface exposure)

Image quality: image density, thin line reproducibility, character blur, resolution, and background smear of the output images were totally evaluated.

Further, after serial printing on 500,000 sheets was completed, thickness measurement was performed to evaluate the amount of wear based on the difference between the thickness before printing and the thickness after printing. The results are shown in Table 20.

TABLE 20

| | Initially | | | After printing on 500,000 sheets | | | |
|---|---|---|---|---|---|---|---|
| | VD (−V) | VL (−V) | Image quality | VD (−V) | VL (−V) | Image quality | Wear amount (μm) |
| Example 31 | 610 | 90 | fine | 605 | 85 | fine | 1.3 |
| Example 32 | 610 | 90 | fine | 610 | 95 | fine | 1.1 |
| Example 33 | 610 | 90 | fine | 600 | 85 | fine | 1.6 |
| Example 34 | 610 | 90 | fine | 603 | 80 | fine | 2.4 |
| Comparative Example 31 | 610 | 90 | fine | 410 | 145 | heavy background smear | ≥5.0 |
| Comparative Example 32 | 610 | 90 | fine | 655 | 275 | image density degraded | 1.0 |

*Comparative Example 31 lost the protection layer completely by wear and allowed wear to go into the charge transporting layer.

Example 35

The process up to the formation of a charge transporting layer was performed in the same manner as Example 5, and a protection layer was manufactured in the manner described below.

Next, titanium oxide (TTO-51, manufactured by Ishihara Sangyo Kaisha Co., Ltd., average primary particle diameter of 0.02 μm) (3.0 parts by mass), cyclohexanone (15 parts by mass), and tetrahydrofuran (38 parts by mass) were added together, and an acrylic resin (ACRYDIC BZ1160, 44% by mass solid content, manufactured by DIC Corporation) (3.9 parts by mass), an alkoxy oligomer (KR-513 manufactured by Shin-Etsu Chemical Co., Ltd.) (0.5 parts by mass), and a charge transporting material having the structural formula (3) given above (1.2 parts by mass) were further added thereto. The resultant was subjected to dispersion for 12 hours with a ball mill using alumina balls as media, to thereby obtain a preparation B4.

Next, titanium oxide (CR-EL, manufactured by Ishihara Sangyo Kaisha Co., Ltd.) (3.0 parts by mass) and cyclohexanone (7 parts by mass) were added together, and the resultant was subjected to dispersion for 12 hours with a ball mill using alumina balls as media. The obtained dispersion liquid was mixed and stirred with the preparation B4, to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 155° C. for 20 minutes to form a protection layer having a thickness of 6.5 μm, to thereby obtain an electrophotographic photoconductor.

Example 36

A photoconductor was manufactured in the same manner as

Example 35, except that the metal oxide to be added in the production of the preparation B4 was changed to conductive Sb-doped tin oxide (SN-100P, manufactured by Ishihara Sangyo Kaisha Co., Ltd., average primary particle diameter of 0.02 μm).

Example 37

A photoconductor was manufactured in the same manner as Example 35, except that titanium oxide to be added to the titanium oxide dispersion liquid to be added to the protection layer preparation B4 of Example 35 was changed to titanium oxide (ET-300W, manufactured by Ishihara Sangyo Kaisha Co., Ltd., average primary particle diameter of 0.045 μm).

Comparative Example 33

A photoconductor was manufactured in the same manner as Example 35, except that titanium oxide to be added to the titanium oxide dispersion liquid to be added to the protection layer preparation B4 of Example 35 was changed to titanium oxide (PT-401W, manufactured by Ishihara Sangyo Kaisha Co., Ltd., average primary particle diameter of 0.07 μm).

The constitutional contents of the protection layers of Examples 35 to 37 and Comparative Example 33 were as shown in Table 21 below.

TABLE 21

| | d(1)/d(2) | Metal oxide content | Particle diameter (small)/particle diameter (large) |
|---|---|---|---|
| Example 35 | 0.08 | 63.7 | 1.00 |
| Example 36 | 0.08 | 63.7 | 1.00 |
| Example 37 | 0.18 | 63.7 | 1.00 |
| Comparative Example 33 | 0.28 | 63.7 | 1.00 |

The electrophotographic photoconductors of Examples 35 to 37 and Comparative Example 33 manufactured in the way described above were attached to the electrophotographic process cartridge of a digital full-color printer (IPSIO SP C811 manufactured by Ricoh Company Ltd.) of which image exposure light source was changed to a 780 nm LD. The voltage of the charging device was adjusted such that the dark space potential (VD) would become −720 V at a temperature of 25° C. and a humidity of 50% RH, and the light volume of the LD was adjusted such that the light space potential (VL) would become −125 V. The contact pressure of the cleaning blade was changed to 1.3 times as large as the original contact pressure.

Under the conditions described above, printing was performed on 110,000 sheets at 25° C./50% RH, on 110,000 sheets at 15° C./20% RH, and on 110,000 sheets at 30° C./90% RH. The internal potential and thickness of the used apparatus were measured after printing on 110,000 sheets at each set of conditions, and the amount of wear was evaluated based on the difference between the thickness before printing and the thickness after printing. The results are shown in Table 22 below.

TABLE 22

| | Initially at 25° C./ 50% RH | | After printing on 110,000 sheets at 25° C./ 50% RH | | After printing on 110,000 sheets at 15° C./ 20% RH | | After printing on 110,000 sheets at 30° C./ 90% RH | | After printing on 330,000 sheets |
|---|---|---|---|---|---|---|---|---|---|
| | VD (−V) | VL (−V) | VD (−V) | VL (−V) | VD (−V) | VL (−V) | VD (−V) | VL (−V) | Wear amount (μm) |
| Example 35 | 720 | 125 | 720 | 128 | 715 | 130 | 700 | 138 | 0.6 |
| Example 36 | 720 | 125 | 720 | 123 | 715 | 128 | 705 | 125 | 0.6 |
| Example 37 | 720 | 125 | 720 | 123 | 710 | 128 | 690 | 125 | 2.0 |
| Comparative Example 33 | 720 | 125 | 600 | 130 | 535 | 145 | 500 | 158 | 4.5 |

Example 38

In Example 31, the aluminum drum was changed to a diameter of 30 mm and a length of 340 mm, and the protection layer was changed to the following prescription.

An acrylic resin (ACRYDIC BZ1160-BA, 37% by mass solid content, manufactured by DIC Corporation) (3.7 parts by mass) and an alkoxy oligomer (KR-500 manufactured by Shin-Etsu Chemical Co., Ltd.) (0.52 parts by mass) were dissolved in cyclohexanone (9 parts by mass) and tetrahydrofuran (36 parts by mass). Then, zinc oxide (FZO-50, manufactured by Ishihara Sangyo Kaisha Co., Ltd., average primary particle diameter of 0.021 μm) (2.6 parts by mass) was added to the obtained dissolution liquid, and the resultant was subjected to dispersion for 12 hours with a ball mill using alumina balls as media. After this, a charge transporting material having the structural formula (2) given above (1.50 parts by mass) was dissolved in the obtained dispersion liquid, to thereby obtain a preparation C4.

Next, aluminum oxide (SUMICORUNDUM AA-03, manufactured by Sumitomo Chemical Co., Ltd., average primary particle diameter of 0.4 μm) (2.6 parts by mass), toluene (3.5 parts by mass), and cyclohexanone (3.5 parts by mass were added together, and the resultant was subjected to dispersion for 12 hours with a ball mill using alumina balls as media. The obtained dispersion liquid was mixed and stirred with the preparation C4 to thereby obtain a protection layer coating liquid.

The charge transporting layer was coated with this protection layer coating liquid by spray coating. The resultant base was left for 1 minute while being rotated so as to be dried until the surface was not wet when touched by a finger. After this, the resultant was subjected to thermal curing at 150° C. for 15 minutes to form a protection layer having a thickness of 7.0 μm.

Comparative Example 34

A photoconductor was manufactured in the same manner as Example 38, except that in the production of the protection layer coating liquid of Example 38, zinc oxide (FZO-50) was changed to 1.5 parts by mass, the acrylic resin (BZ1160-BA) was changed to 4.63 parts by mass, the alkoxy oligomer (KR-500) was changed to 0.65 parts by mass, the charge transporting material having the structural formula (2) was changed to 1.80 parts by mass, and aluminum oxide (AA-03) was changed to 1.5 parts by mass.

Comparative Example 35

A photoconductor was manufactured in the same manner as Example 38, except that in the production of the protection layer coating liquid of Example 38, zinc oxide (FZO-50) was changed to 1.0 part by mass, the acrylic resin (BZ1160-BA) was changed to 5.55 parts by mass, the alkoxy oligomer (KR-500) was changed to 0.78 parts by mass, the charge transporting material having the structural formula (2) was changed to 2.20 parts by mass, and aluminum oxide (AA-03) was changed to 1.0 part by mass.

Reference Example 2

A photoconductor was manufactured in the same manner as Example 38, except that in the production of the protection layer coating liquid of Example 38, a polycarbonate resin having a bisphenol Z type structure (PANLITE TS2050 manufactured by Teijin Chemicals Ltd.) (1.89 parts by mass) was used instead of the acrylic resin and the alkoxy oligomer.

The constitutional contents of the protection layers of each example, comparative example, and reference example were as shown in Table 23 below.

TABLE 23

| | d(1)/d(2) | Metal oxide content | Particle diameter (small)/particle diameter (large) |
|---|---|---|---|
| Example 38 | 0.05 | 60.5 | 1.00 |
| Comparative Example 34 | 0.05 | 41.9 | 1.00 |
| Comparative Example 35 | 0.05 | 28.4 | 1.00 |
| Reference Example 2 | 0.05 | 60.5 | 1.00 |

The electrophotographic photoconductors of Example 38, Comparative Examples 34 and 35, and Reference Example 2 manufactured in the way described above were attached to the electrophotographic process cartridge of a digital full-color printer IPSIO COLOR 8100 (manufactured by Ricoh Company Ltd.). The voltage of the charging device was adjusted such that the dark space potential (VD) would become −825 V, and the light volume of LD was adjusted such that the light space potential (VL) would become −130 V.

After this, printing was performed on 120,000 sheets serially at a temperature of 25° C. and a humidity of 50% RH, and thickness measurement was performed to evaluate the amount of wear based on the difference between the thickness before printing and the thickness after printing. The results are shown in Table 24 below.

TABLE 24

| | Initially | | After printing on 120,000 sheets | | |
|---|---|---|---|---|---|
| | VD (−V) | VL (−V) | VD (−V) | VL (−V) | Wear amount (μm) |
| Example 38 | 825 | 130 | 815 | 130 | 0.7 |
| Comparative Example 34 | 825 | 130 | 570 | 170 | 5.5 |
| Comparative Example 35 | 825 | 130 | 480 | 220 | 9.0 |
| Reference Example 2 | 825 | 130 | 810 | 150 | 1.3 |

From the above Examples, it turned out that the present invention can provide an electrophotographic photoconductor, an image forming method, an image forming apparatus, and a process cartridge that have a high wear resistance and excellent electrophotographic properties, and can perform stable image formation for a long time.

Aspects of the present invention are as follows, for example.

<1> An electrophotographic photoconductor, including:

an electroconductive substrate;

a photoconductive layer on the electroconductive substrate; and a protection layer on the photoconductive layer, wherein the protection layer contains two or more metal oxides having different average primary particle diameters, a binder resin, and a charge transporting material, and wherein a content of the metal oxides in the protection layer is 50% by mass or higher, and the average primary particle diameters of the metal oxides satisfy all of the formulae (I) to (III) below:

$$d(1)<d(2) \quad \text{formula (I);}$$

$$d(1)/d(2)\leq 0.25 \quad \text{formula (II); and}$$

$$0.1\ \mu m\leq d(2) \quad \text{formula (III)}$$

where d(1) represents the average primary particle diameter (1 μm) of one metal oxide of the two or more metal oxides contained in the protection layer, and d(2) represents the average primary particle diameters (μm) of another or the other metal oxide of the two or more metal oxides contained in the protection layer.

<2> The electrophotographic photoconductor according to <1>, wherein the two or more metal oxides having the different average primary particle diameters are of a same kind.

<3> The electrophotographic photoconductor according to <1>, wherein the two or more metal oxides having the different average primary particle diameters are of different kinds.

<4> The electrophotographic photoconductor according to any one of <1> to <3>, wherein the protection layer contains an acid group-containing compound.

<5> The electrophotographic photoconductor according to any one of <1> to <4>, wherein the binder resin contains a product obtained by curing an acrylic resin and a silane coupling agent.

<6> The electrophotographic photoconductor according to any one of <1> to <5>, wherein the binder resin contains a product obtained by curing an acrylic resin and an alkoxy oligomer.

<7> The electrophotographic photoconductor according to any one of <1> to <6>, wherein the metal oxides satisfy the formula (IV) below:

$$1/5\ A/B \leq 5/1 \quad \text{formula (IV)}$$

where A represents a content of the metal oxide having the average primary particle diameter d(1), and B represents a content of the metal oxide having the average primary particle diameter d(2)<

8> The electrophotographic photoconductor according to any one of <1> to <7>, wherein of the two or more metal oxides, the metal oxide having the average primary particle diameter d(1) is an electroconductive metal oxide.

<9> The electrophotographic photoconductor according to any one of <1> to <8>, wherein the protection layer has a thickness of 1 μm to 10 μm.

<10> An image forming method, including:

charging a surface of an electrophotographic photoconductor;

exposing the charged surface of the electrophotographic photoconductor to form an electrostatic latent image;

developing the electrostatic latent image with a toner to form a visible image;

transferring the visible image to a recording medium; and fixing the visible image transferred to the recording medium thereon, wherein the electrophotographic photoconductor is the electrophotographic photoconductor according to any one of <1> to <9>.

<11> An image forming apparatus, including:

an electrophotographic photoconductor;

a charging unit configured to charge a surface of the electrophotographic photoconductor;

an exposure unit configured to expose the charged surface of the electrophotographic photoconductor to form an electrostatic latent image;

a developing unit configured to develop the electrostatic latent image with a toner to form a visible image;

a transfer unit configured to transfer the visible image to a recording medium; and a fixing unit configured to fix the transferred image transferred to the recording medium thereon, wherein the electrostatic photoconductor is the electrostatic photoconductor according to any one of <1> to <9>.

<12> A process cartridge, including:

an electrophotographic photoconductor; and a developing unit configured to develop an electrostatic latent image on the electrophotographic photoconductor with a toner to form a visible image, wherein the electrophotographic photoconductor is the electrophotographic photoconductor according to any one of <1> to <9>.

This application claims priority to Japanese application No. 2012-235292, filed on Oct. 25, 2012 and incorporated herein by reference.

What is claimed is:

1. An electrophotographic photoconductor, comprising:

an electroconductive substrate;

a photoconductive layer on the electroconductive substrate; and a protection layer on the photoconductive layer, wherein the protection layer contains two or more metal oxides having different average primary particle diameters, a binder resin, and a charge transporting material, wherein the metal oxides are selected from the group consisting of zinc oxide, titanium oxide, tin oxide, antimony oxide, indium oxide, aluminum oxide, tin-doped indium oxide, tin-doped tin oxide, antimony-doped tin oxide, antimony-doped zirconium oxide, and antimony-doped zinc oxide, and wherein a content of the metal oxides in the protection layer is 50% by mass or higher, and the average primary particle diameters of the metal oxides satisfy all of formulae (I) to (III) below:

$$d(1)<d(2) \quad \text{formula (I);}$$

$$d(1)/d(2) \leq 0.25 \quad \text{formula (II); and}$$

$$0.1\ \mu m \leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxides of the two or more metal oxides contained in the protection layer.

2. The electrophotographic photoconductor according to claim 1, wherein the two or more metal oxides having the different average primary particle diameters are of the same metal oxide.

3. The electrophotographic photoconductor according to claim 1, wherein the two or more metal oxides having the different average primary particle diameters are of different metal oxides.

4. The electrophotographic photoconductor according to claim 1, wherein the protection layer contains an acid group-containing compound.

5. The electrophotographic photoconductor according to claim 1, wherein the binder resin contains a product obtained by curing an acrylic resin and a silane coupling agent.

6. The electrophotographic photoconductor according to claim 1, wherein the binder resin contains a product obtained by curing an acrylic resin and an alkoxy oligomer.

7. The electrophotographic photoconductor according to claim 1, wherein the metal oxides satisfy formula (IV) below:

$$1/5 \leq A/B \leq 5/1 \quad \text{formula (IV)}$$

where A represents a content of the metal oxide having the average primary particle diameter d(1), and B represents a content of the metal oxide having the average primary particle diameter d(2).

8. The electrophotographic photoconductor according to claim 1, wherein of the two or more metal oxides, the metal oxide having the average primary particle diameter d(1) is an electroconductive metal oxide.

9. The electrophotographic photoconductor according to claim 1, wherein the protection layer has a thickness of 1 μm to 10 μm.

10. The electrophotographic photoconductor according to claim 1, wherein the content of the metal oxides in the protection layer is 56.9% by mass or higher.

11. An image forming apparatus, comprising:

an electrophotographic photoconductor;

a charging unit configured to charge a surface of the electrophotographic photoconductor;

an exposure unit configured to expose the charged surface of the electrophotographic photoconductor to form an electrostatic latent image;

a developing unit configured to develop the electrostatic latent image with a toner to form a visible image;

a transfer unit configured to transfer the visible image to a recording medium; and a fixing unit configured to fix the visible image transferred to the recording medium thereon, wherein the electrophotographic photoconductor comprises an electroconductive substrate, a photoconductive layer on the electroconductive substrate, and a protection layer on the photoconductive layer, wherein the protection layer contains two or more metal oxides having different average primary particle diameters, a binder resin, and a charge transporting material, wherein the metal oxides are selected from the group consisting of zinc oxide, titanium oxide, tin oxide, antimony oxide, indium oxide, aluminum oxide, tin-doped indium oxide, tin-doped tin oxide, antimony-doped tin oxide, antimony-doped zirconium oxide, and antimony-doped zinc oxide, and wherein a content of the metal oxides in the protection layer is 50% by mass or higher, and the average primary particle diameters of the metal oxides satisfy all of formulae (I) to (III) below:

$$d(1)<d(2) \quad \text{formula (I);}$$

$$d(1)/d(2)\leq 0.25 \quad \text{formula (II); and}$$

$$0.1\ \mu m\leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

12. The image forming apparatus according to claim 11, wherein the content of the metal oxides in the protection layer is 56.9% by mass or higher.

13. A process cartridge, comprising:

an electrophotographic photoconductor; and a developing unit configured to develop an electrostatic latent image on the electrophotographic photoconductor with a toner to form a visible image, wherein the electrophotographic photoconductor comprises an electroconductive substrate, a photoconductive layer on the electroconductive substrate, and a protection layer on the photoconductive layer, wherein the protection layer contains two or more metal oxides having different average primary particle diameters, a binder resin, and a charge transporting material, wherein the metal oxides are selected from the group consisting of zinc oxide, titanium oxide, tin oxide, antimony oxide, indium oxide, aluminum oxide, tin-doped indium oxide, tin-doped tin oxide, antimony-doped tin oxide, antimony-doped zirconium oxide, and antimony-doped zinc oxide, and wherein a content of the metal oxides in the protection layer is 50% by mass or higher, and the average primary particle diameters of the metal oxides satisfy all of formulae (I) to (III) below:

$$d(1)<d(2) \quad \text{formula (I);}$$

$$d(1)/d(2)\leq 0.25 \quad \text{formula (II); and}$$

$$0.1\ \mu m\leq d(2) \quad \text{formula (III)}$$

where d(1) represents the average primary particle diameter (μm) of one metal oxide of the two or more metal oxides contained in the protection layer, and d(2) represents the average primary particle diameter (μm) of another or the other metal oxide of the two or more metal oxides contained in the protection layer.

14. The process cartridge according to claim 13, wherein the content of the metal oxides in the protection layer is 56.9% by mass or higher.

* * * * *